US009555947B2

(12) United States Patent
Su et al.

(10) Patent No.: US 9,555,947 B2
(45) Date of Patent: Jan. 31, 2017

(54) VENTED STEAM COOKING PACKAGE

(75) Inventors: Jau-Ming Su, Kent, WA (US); Charisa Sofian, Seattle, WA (US); Paul Z Wolak, Indianapolis, IN (US)

(73) Assignee: Berry Plastics Corporation, Evansville, IN (US)

( * ) Notice: Subject to any disclaimer, the term of this patent is extended or adjusted under 35 U.S.C. 154(b) by 741 days.

(21) Appl. No.: 13/485,334

(22) Filed: May 31, 2012

(65) Prior Publication Data

US 2013/0322790 A1 Dec. 5, 2013

(51) Int. Cl.
*B65D 81/34* (2006.01)

(52) U.S. Cl.
CPC ..... *B65D 81/34* (2013.01); *B65D 81/3461* (2013.01); *B65D 2205/02* (2013.01)

(58) Field of Classification Search
CPC . B65D 33/01; B65D 81/2038; B65D 2205/00; B65D 81/3461; B65D 77/225; B65D 31/04; B65D 81/2023
USPC ..... 383/100–103
See application file for complete search history.

(56) References Cited

U.S. PATENT DOCUMENTS 3,302,859 A * 2/1967 Perry ..... 383/103
3,370,780 A * 2/1968 Shaw ..... 383/94
4,057,144 A * 11/1977 Schuster ..... 206/439
4,141,487 A * 2/1979 Faust ..... B65D 81/343 229/120
5,399,022 A * 3/1995 Sheets ..... 383/103
5,553,942 A * 9/1996 Domke et al. ..... 383/101
5,655,842 A * 8/1997 Hagino ..... B32B 37/1292 220/366.1
5,902,046 A * 5/1999 Shibata ..... 383/107
6,170,985 B1 * 1/2001 Shabram et al. ..... 383/100
6,855,356 B2 * 2/2005 Sugiyama et al. ..... 426/113
7,090,398 B2 * 8/2006 Shibata ..... 383/101
7,812,293 B2 10/2010 Su et al.
7,919,738 B2 4/2011 Su et al.
7,927,015 B2 * 4/2011 Heinemeier ..... B65D 33/01 383/101
8,371,752 B2 * 2/2013 Heinemeier ..... B65D 33/01 383/101
2003/0194158 A1 * 10/2003 Plourde ..... B65D 33/01 383/102
2005/0281493 A1 * 12/2005 Heinemeier et al. ..... 383/103
2006/0257056 A1 * 11/2006 Miyake et al. ..... 383/103
2009/0123094 A1 * 5/2009 Kreymborg et al. ..... 383/103
2011/0024412 A1 2/2011 Su et al.
2011/0097016 A1 * 4/2011 Pollock ..... A45C 3/04 383/10
2011/0163105 A1 7/2011 Su et al.
2014/0241649 A1 * 8/2014 Bockmann et al. ..... 383/103

* cited by examiner

*Primary Examiner* — Peter Helvey
(74) *Attorney, Agent, or Firm* — Barnes & Thornburg LLP

(57) ABSTRACT

A vented steam cooking package includes a container formed to include an interior region and a steam-venting system. The steam-venting system is formed in the package to vent steam from the interior region to atmosphere surrounding the package during heating.

31 Claims, 18 Drawing Sheets

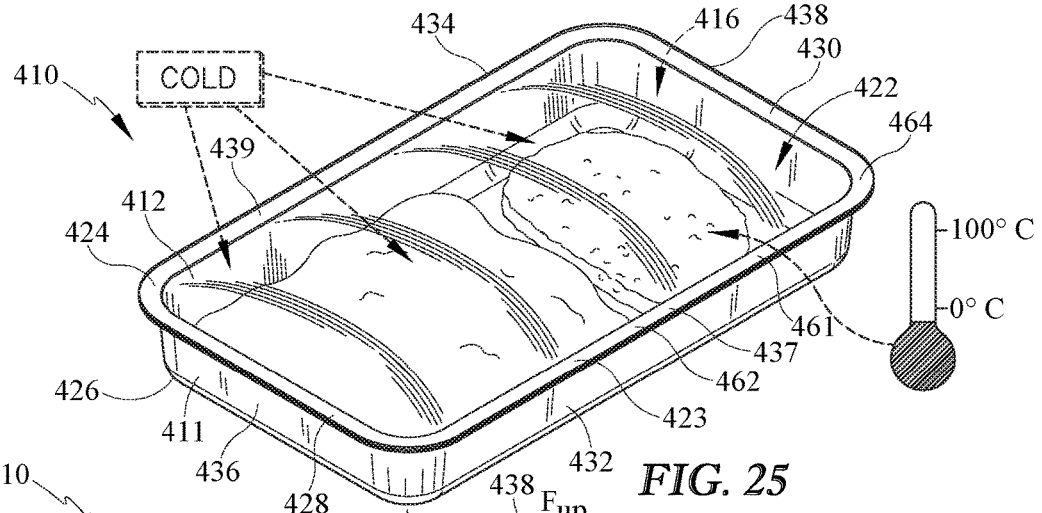
FIG. 25
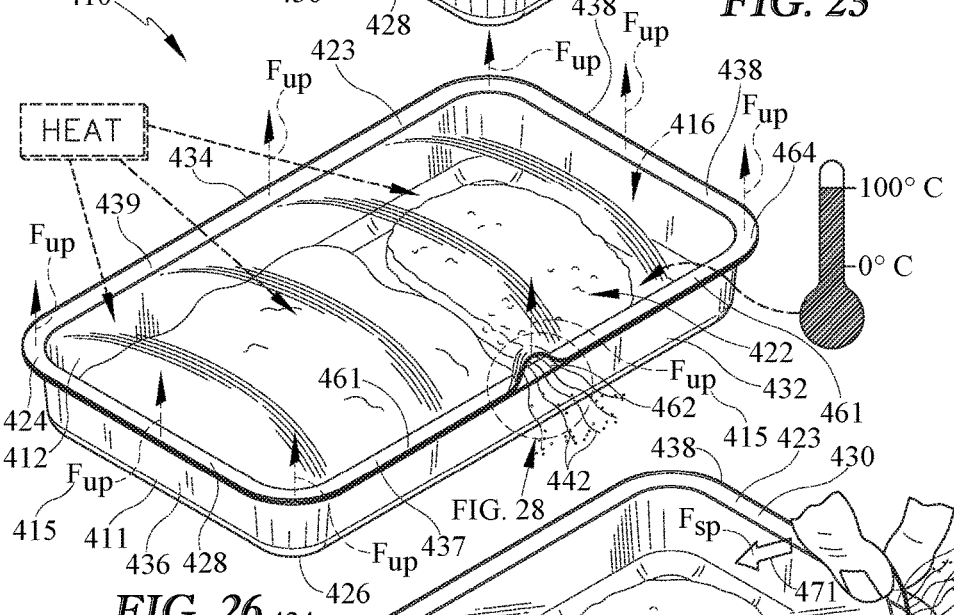
FIG. 26
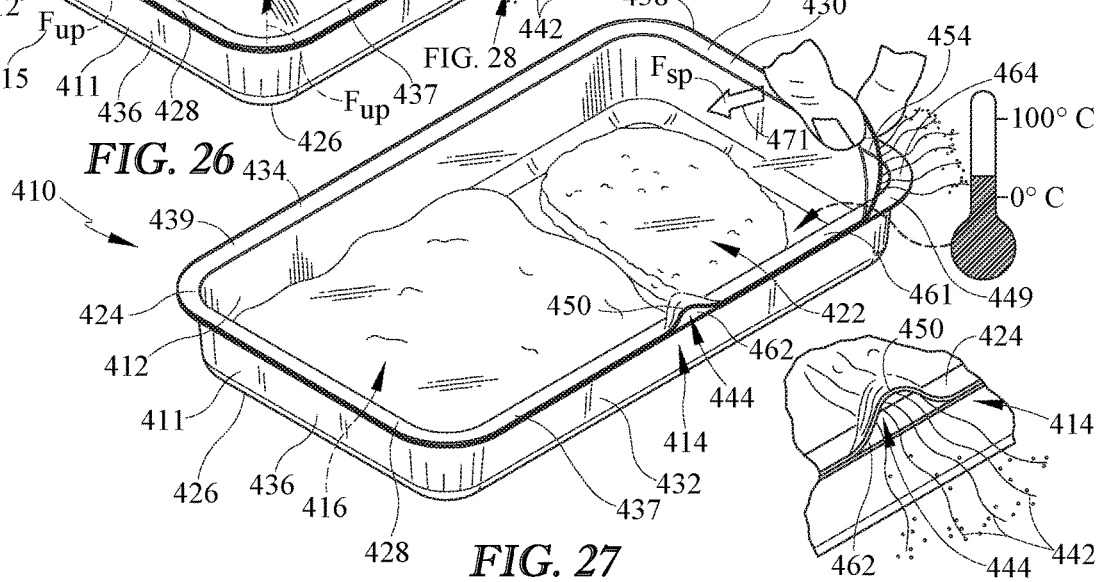
FIG. 27
FIG. 28

VENTED STEAM COOKING PACKAGE

BACKGROUND

The present disclosure relates to a package, and in particular to a package subjected to freezing temperatures during storage or transportation. More particularly, the present disclosure relates to a package subjected to both freezing temperatures and heating temperatures.

SUMMARY

A package in accordance with the present disclosure includes a container and seal fin. The container is formed to include an interior region in which food products may be placed during container forming. The seal fin is coupled to the container along a seal-fin line that extends between a first end of the container and an opposite second end of the container.

In illustrative embodiments, a steam-venting system is formed in the container. The steam-venting system is configured to provide means for venting steam formed in the interior region during heating in a controlled manner to cause temperature and pressure generated in the interior region to be maximized without causing an unintended opening to be formed in the container during heating.

In illustrative embodiments, the container includes a top wall and a bottom wall coupled to the top wall to form the interior region therebetween. The seal fin is coupled to the top wall along the seal-fin line to extend away from the seal-fin line toward a first edge of the container that extends between first and second ends of the container. A portion of the steam-venting system is formed in the top wall between the seal fin and the bottom wall.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective view of the package undergoing freezing showing that the package is subjected to below freezing temperatures as indicated by a thermometer bar to the right of the package that shows a below-freezing temperature of air in the interior region formed in the pillow container;

FIG. 2 is a view similar to FIG. 1 showing that the package is being exposed to heat which causes the temperature in the interior region to increase as shown by the thermometer bar to the right of the package and causes air to expand in the pillow container causing the container to bulge upwardly;

Figure 1:
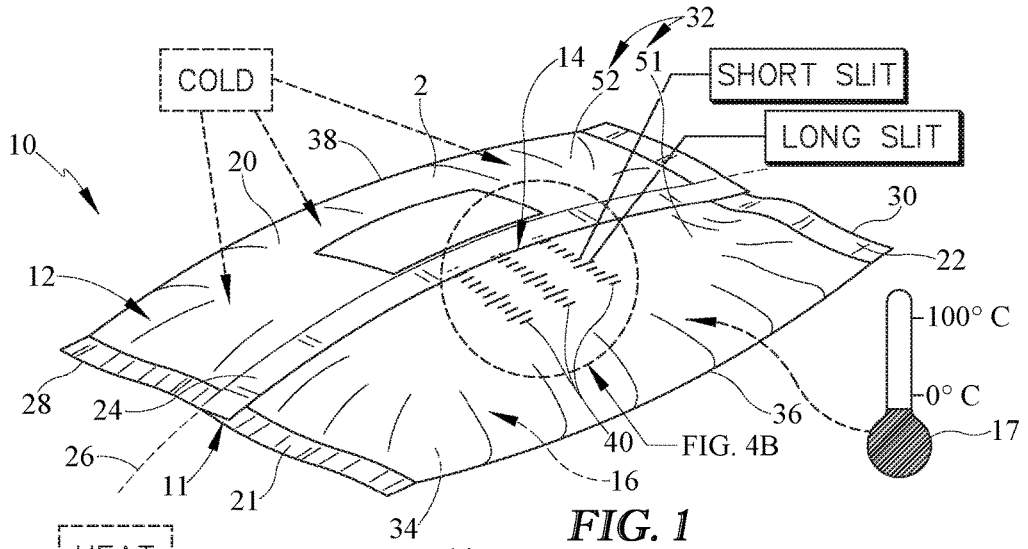
FIGS. 1-3 are a series of views showing a package in accordance with a first embodiment of the present disclosure including a pillow container and a steam-venting system formed in the pillow container to allow steam to escape in a controlled manner from an interior region formed in the pillow container during heating of the package.
Figure 2:
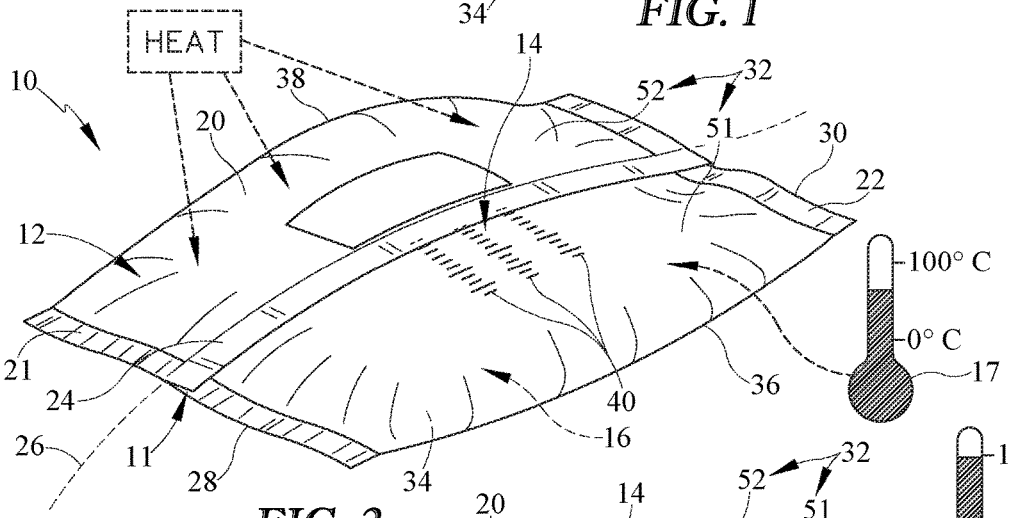
Figure 3:
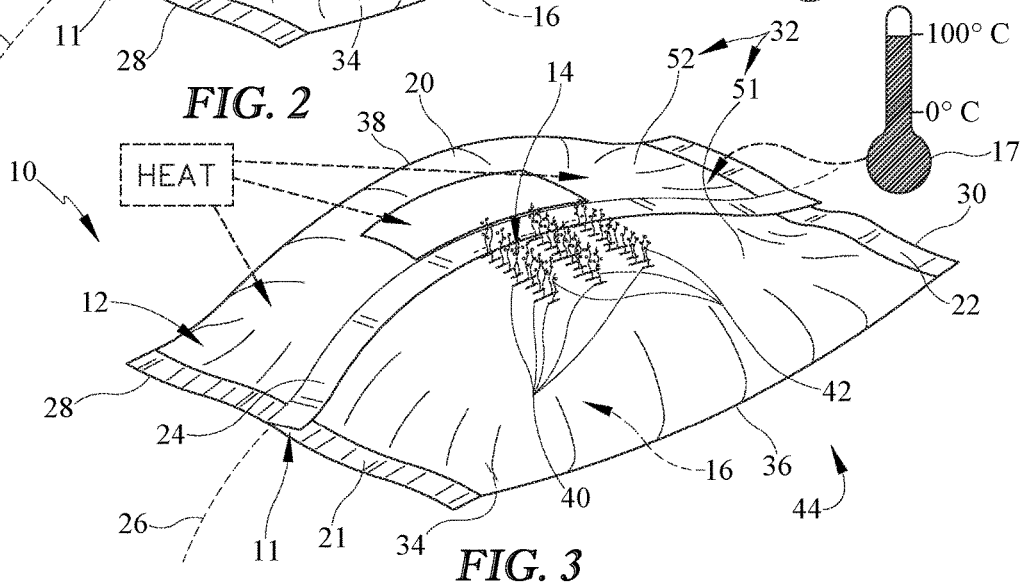
Figure 4A:
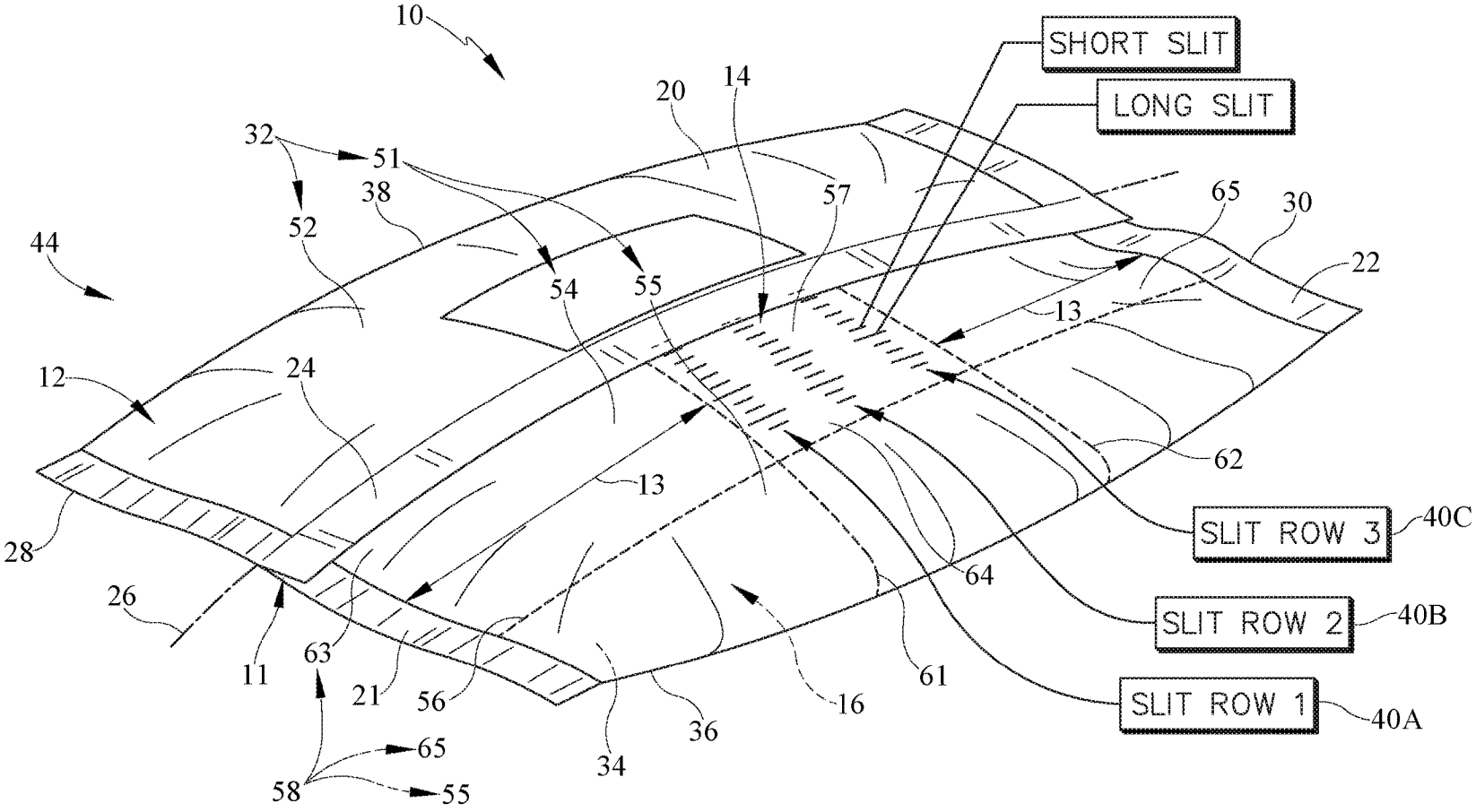
Figure 4B:
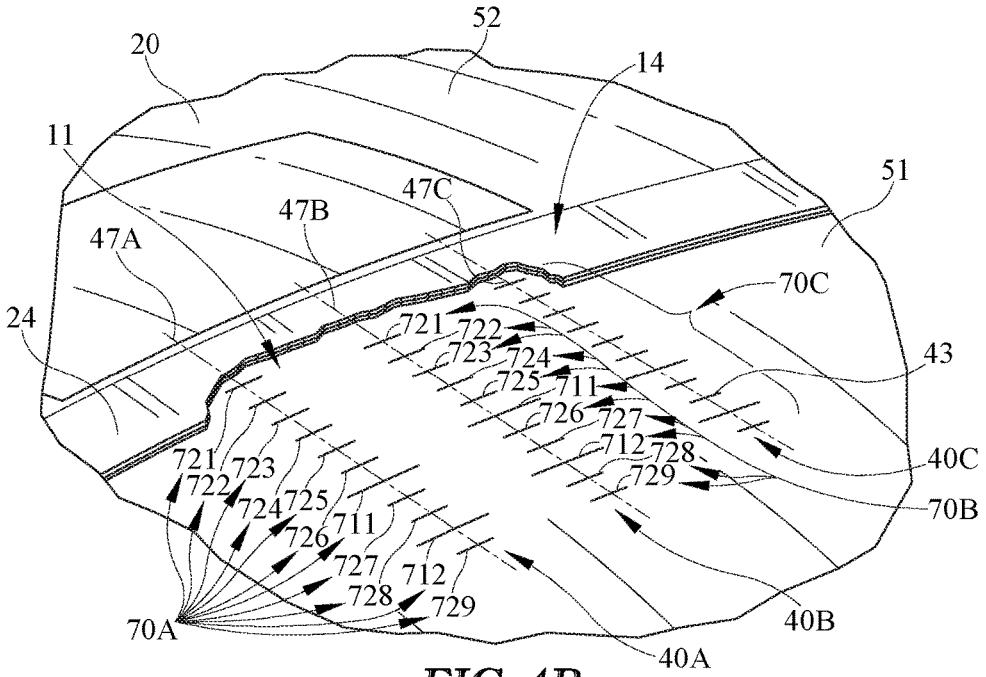
Figure 5:
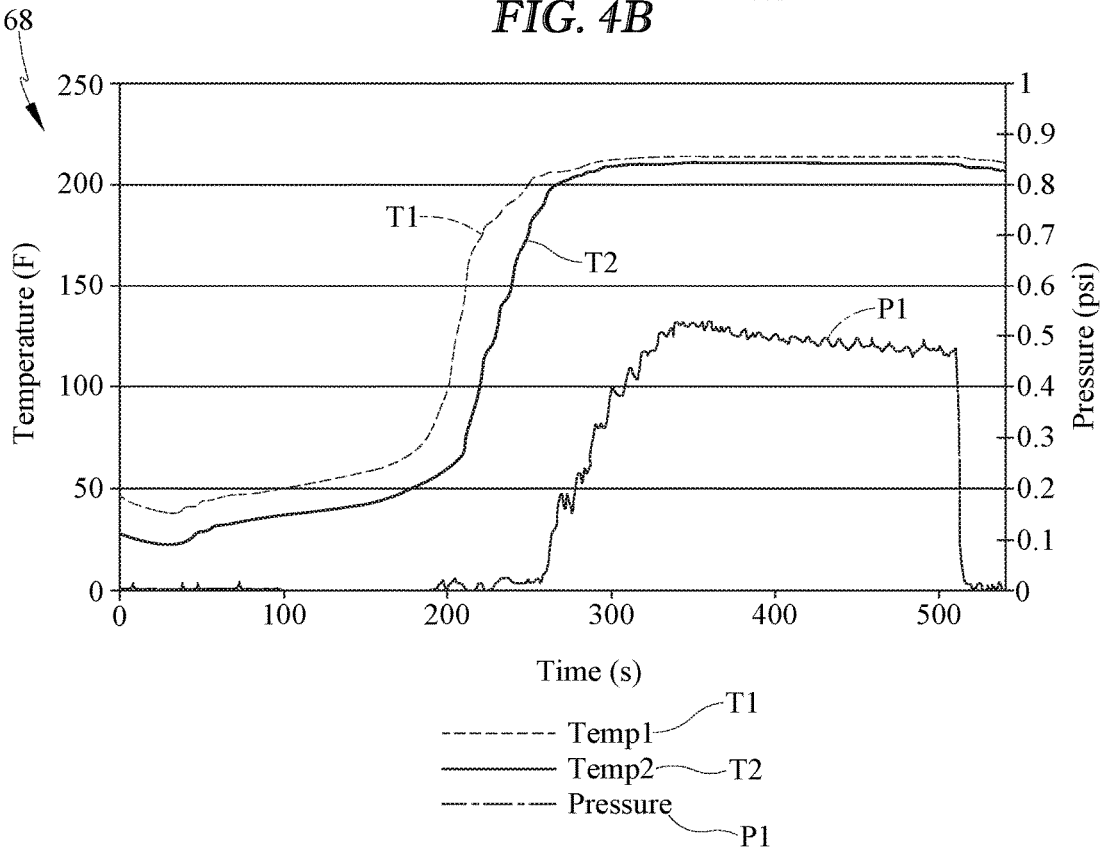
Figure 6:
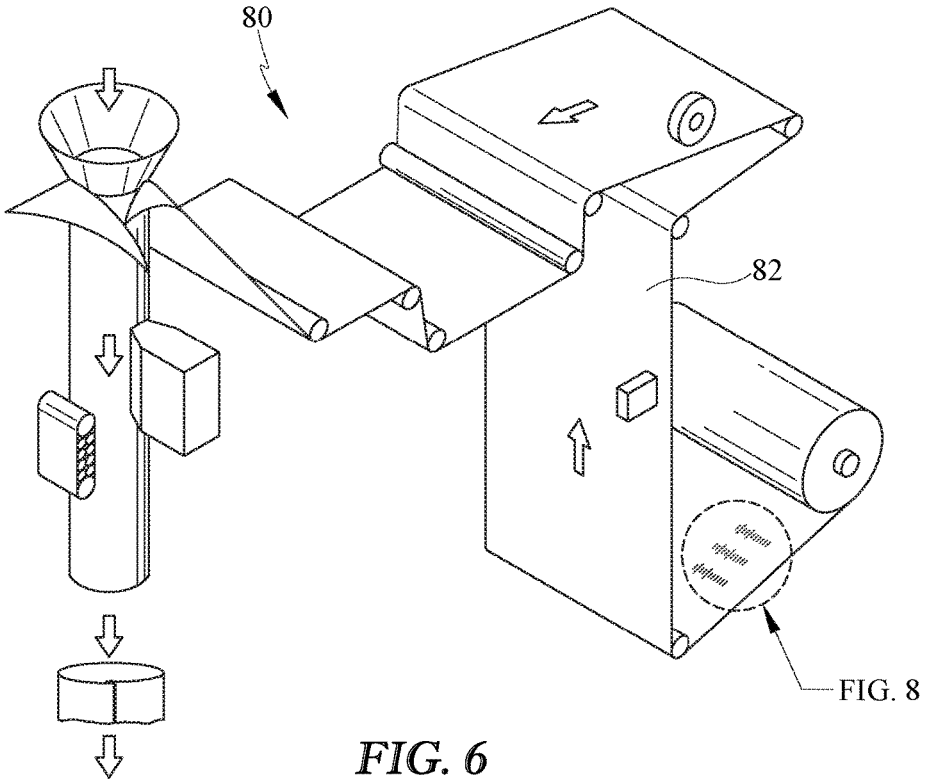
Figure 7:
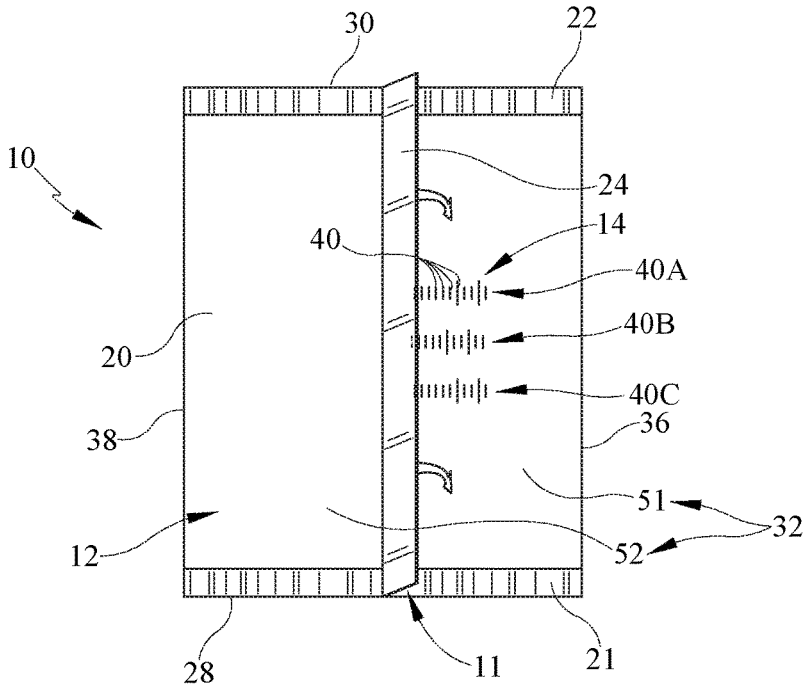
Figure 8:
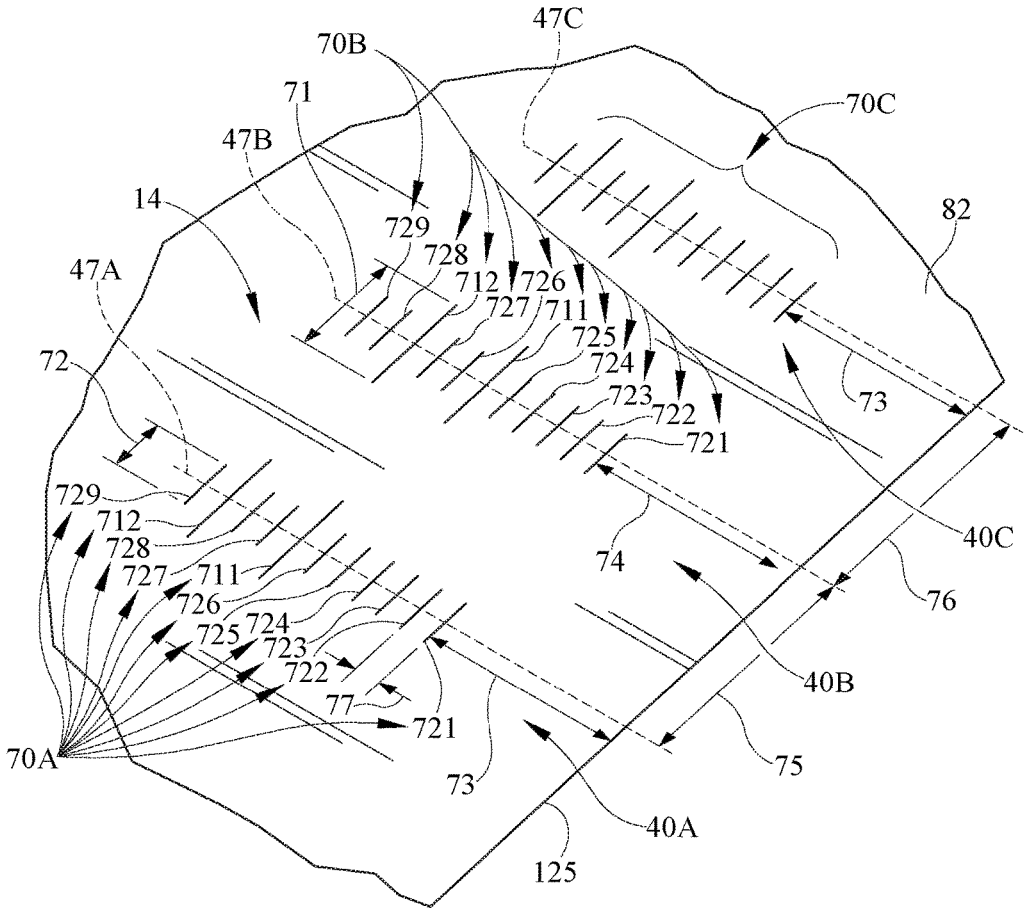
Figure 9:
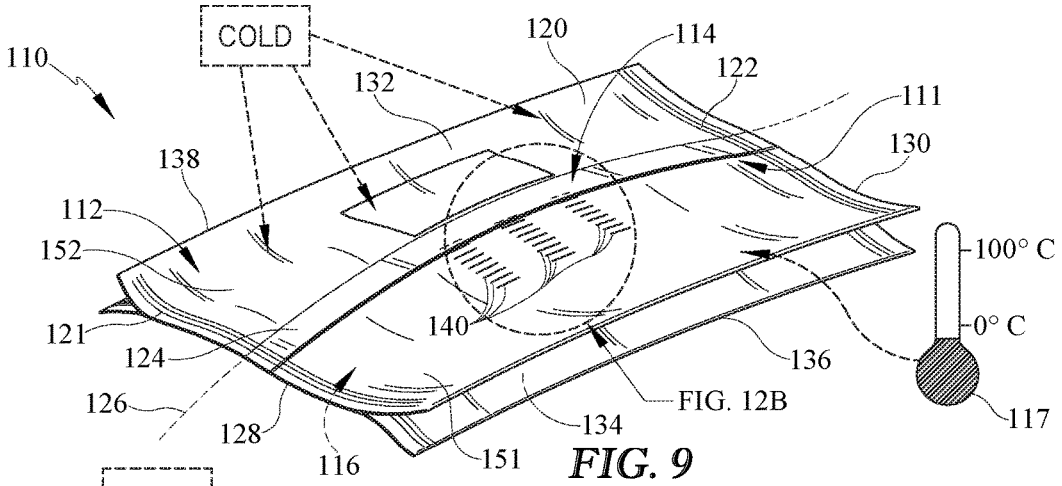
Figure 10:
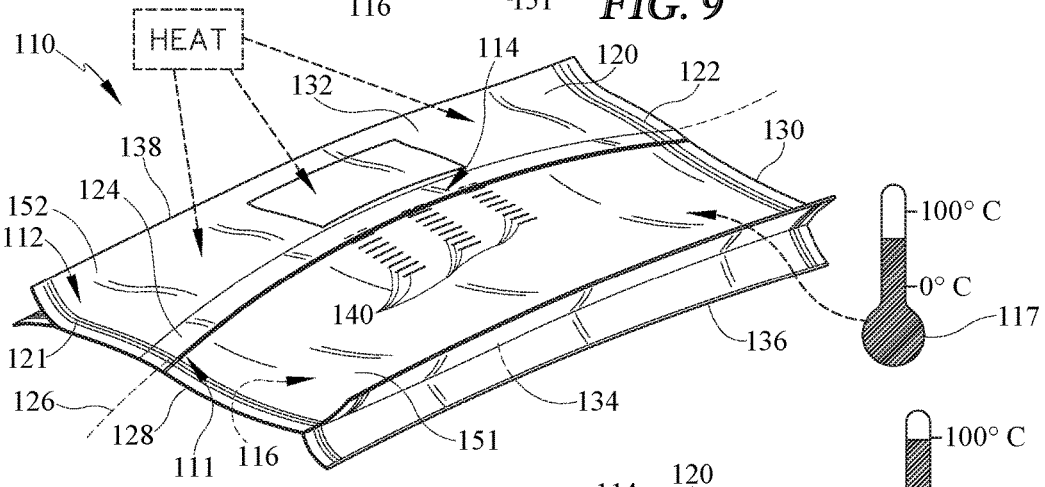
Figure 11:
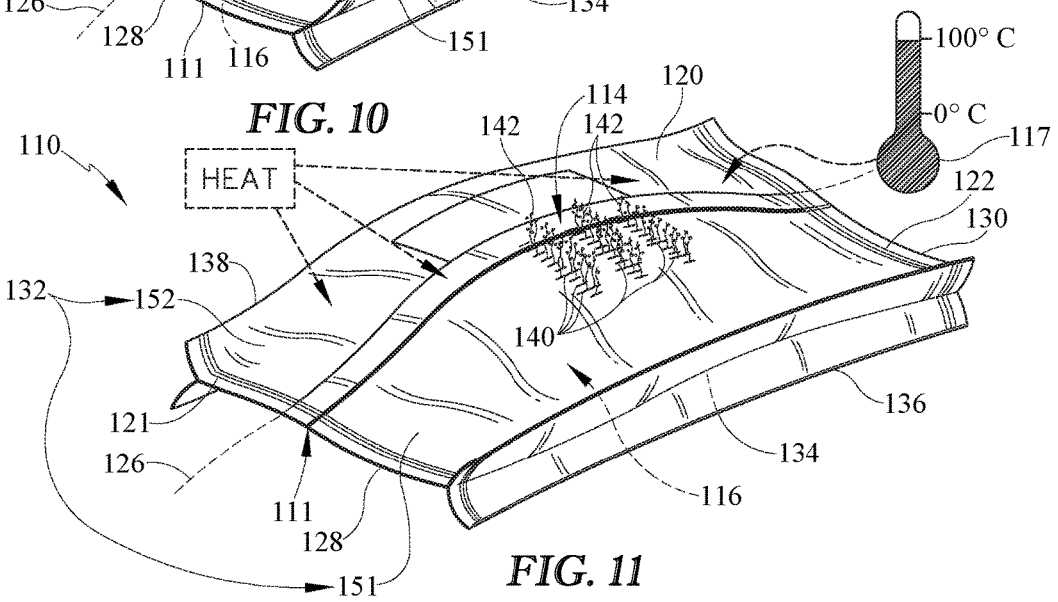
Figure 12A:
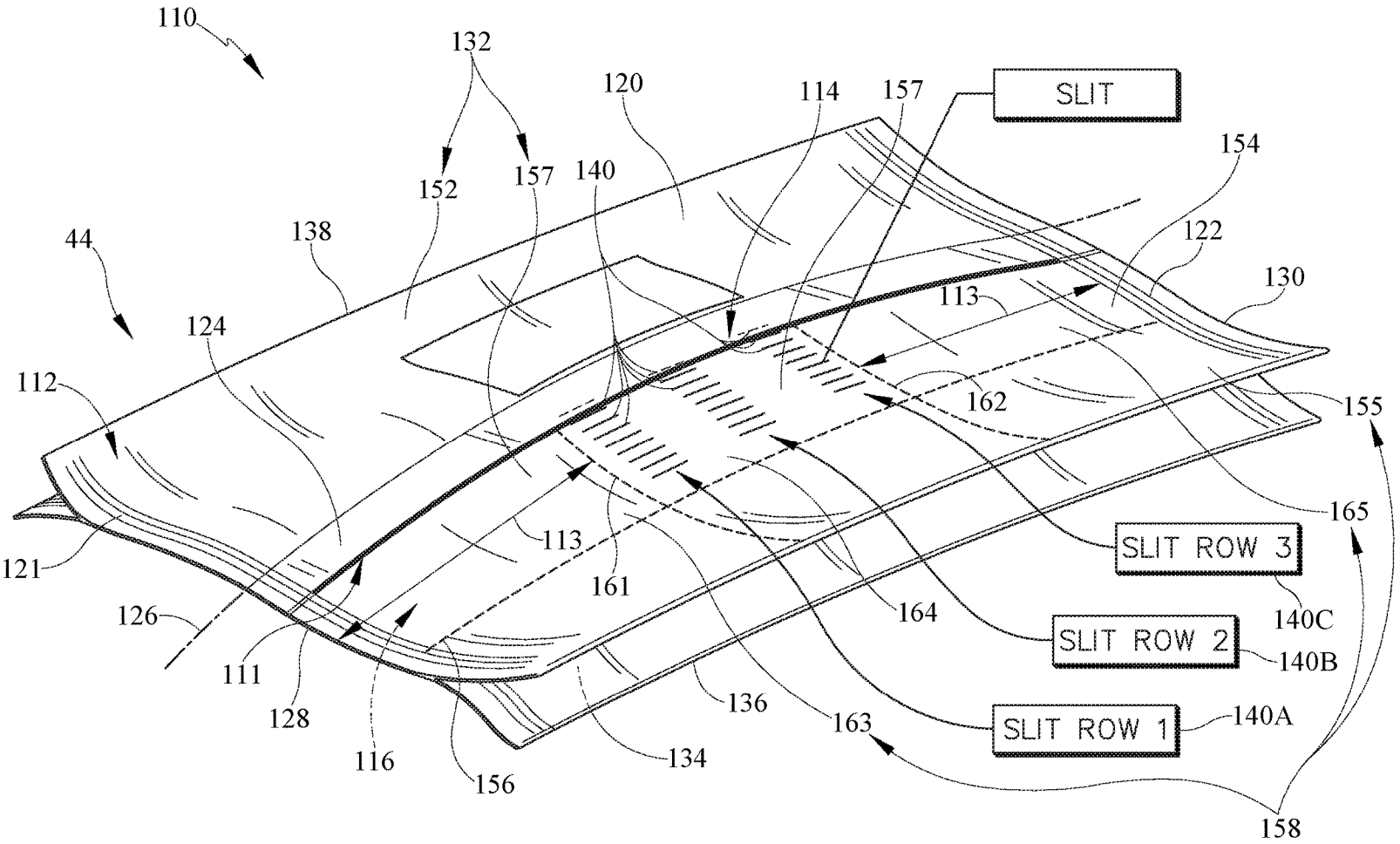
Figure 12B:
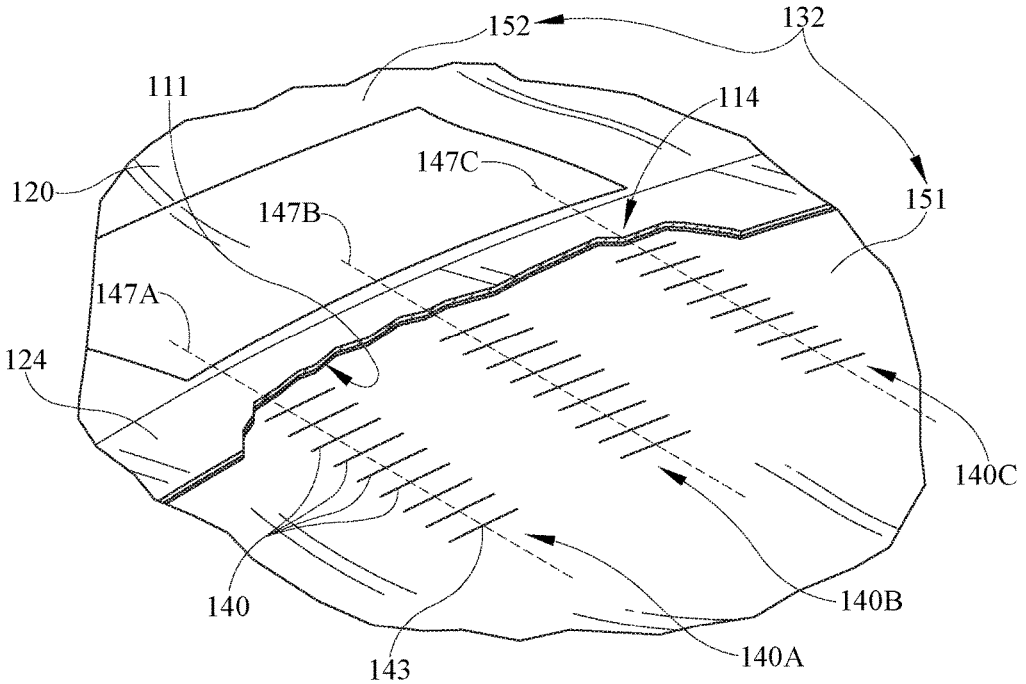
Figure 13:
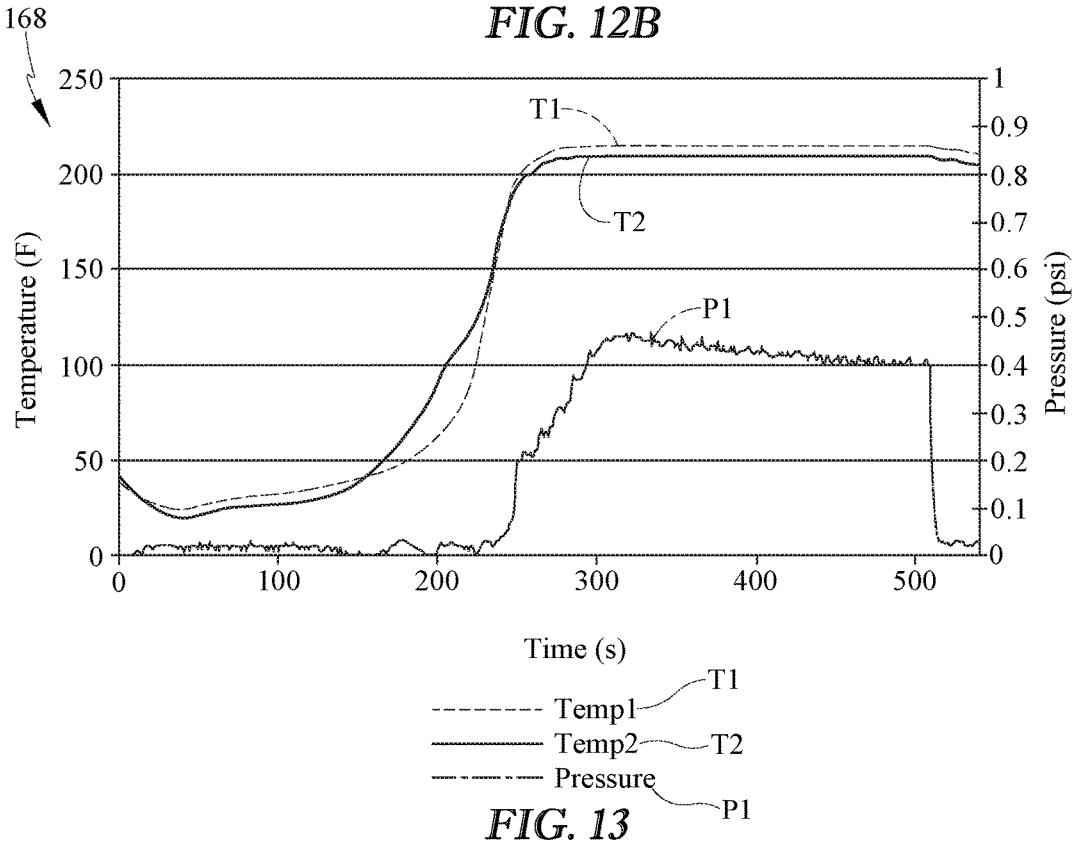
Figure 14:
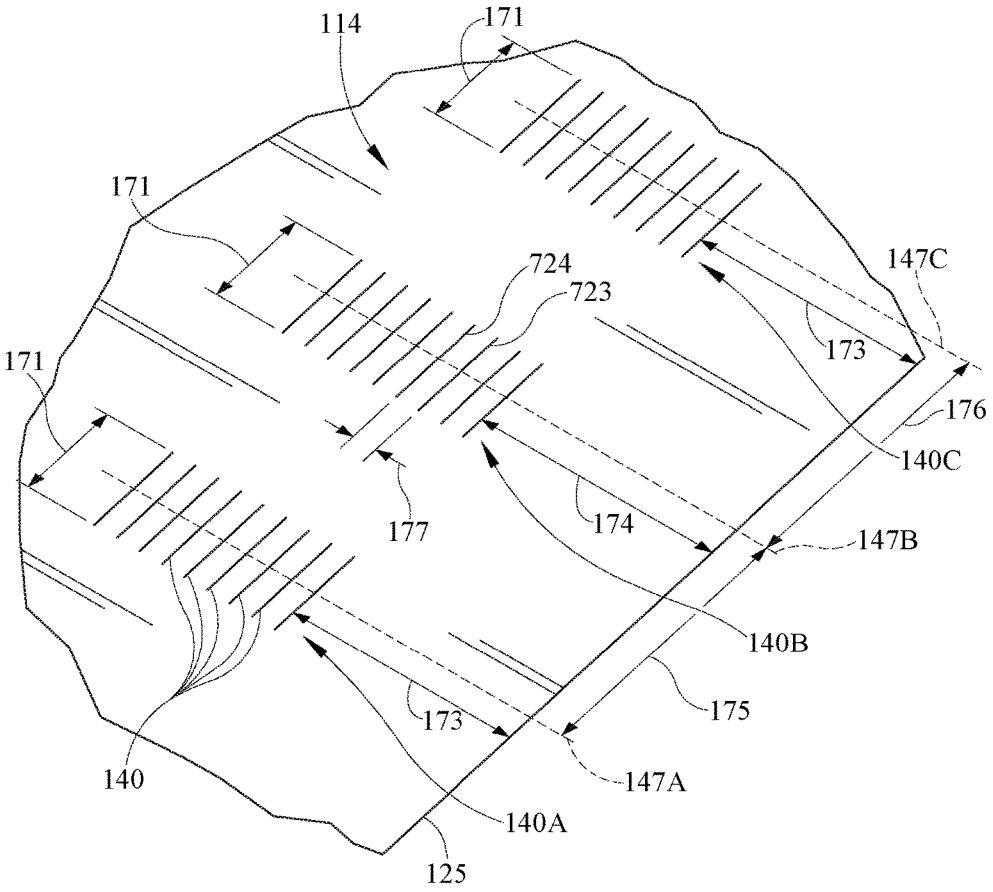
Figure 15:
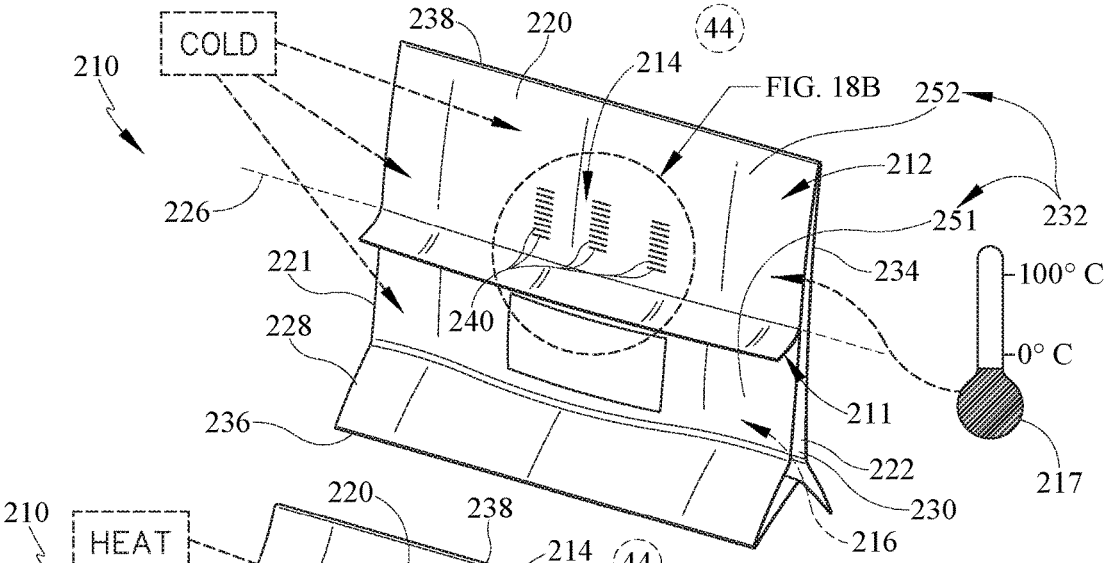
Figure 16:
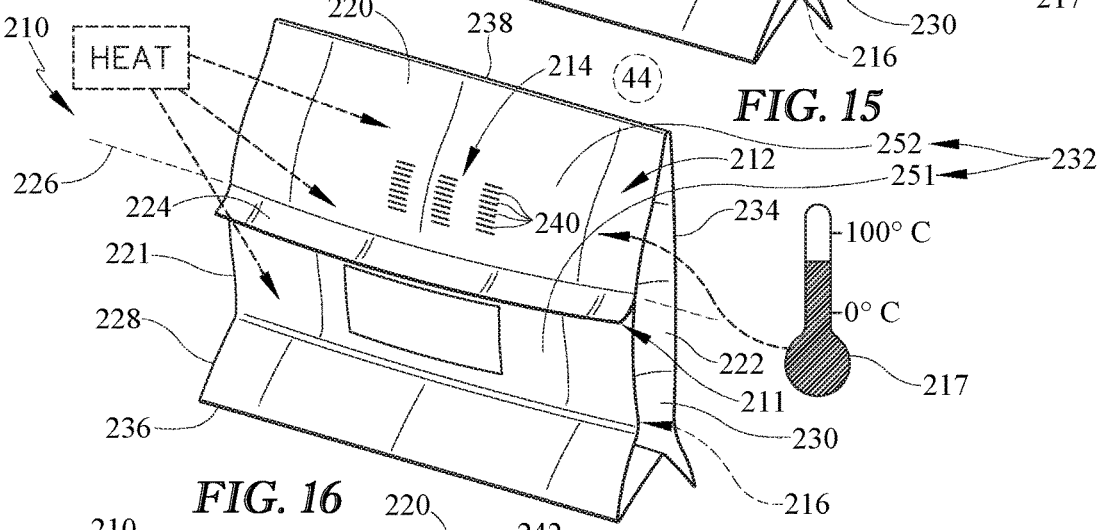
Figure 17:
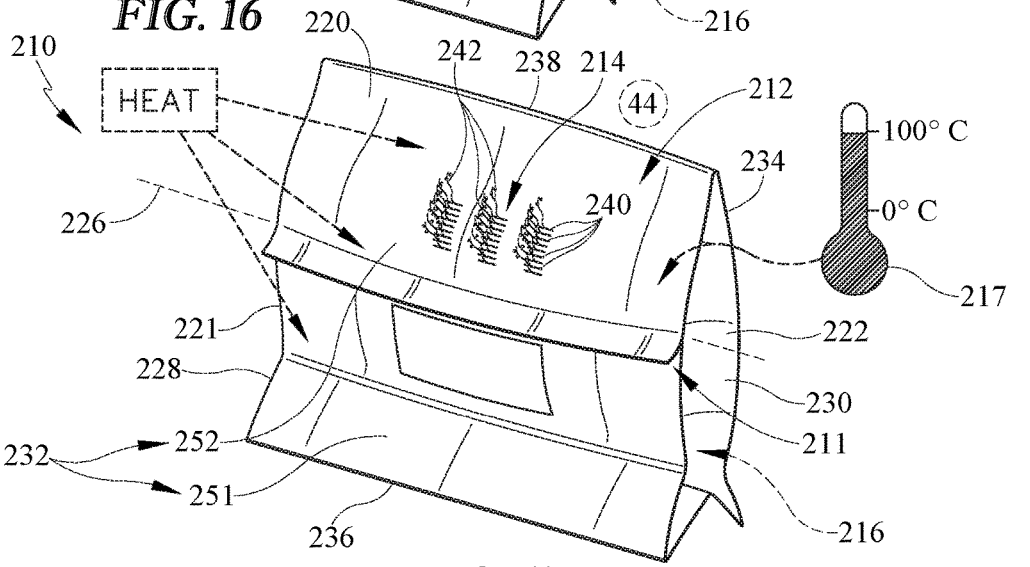
Figure 18A:
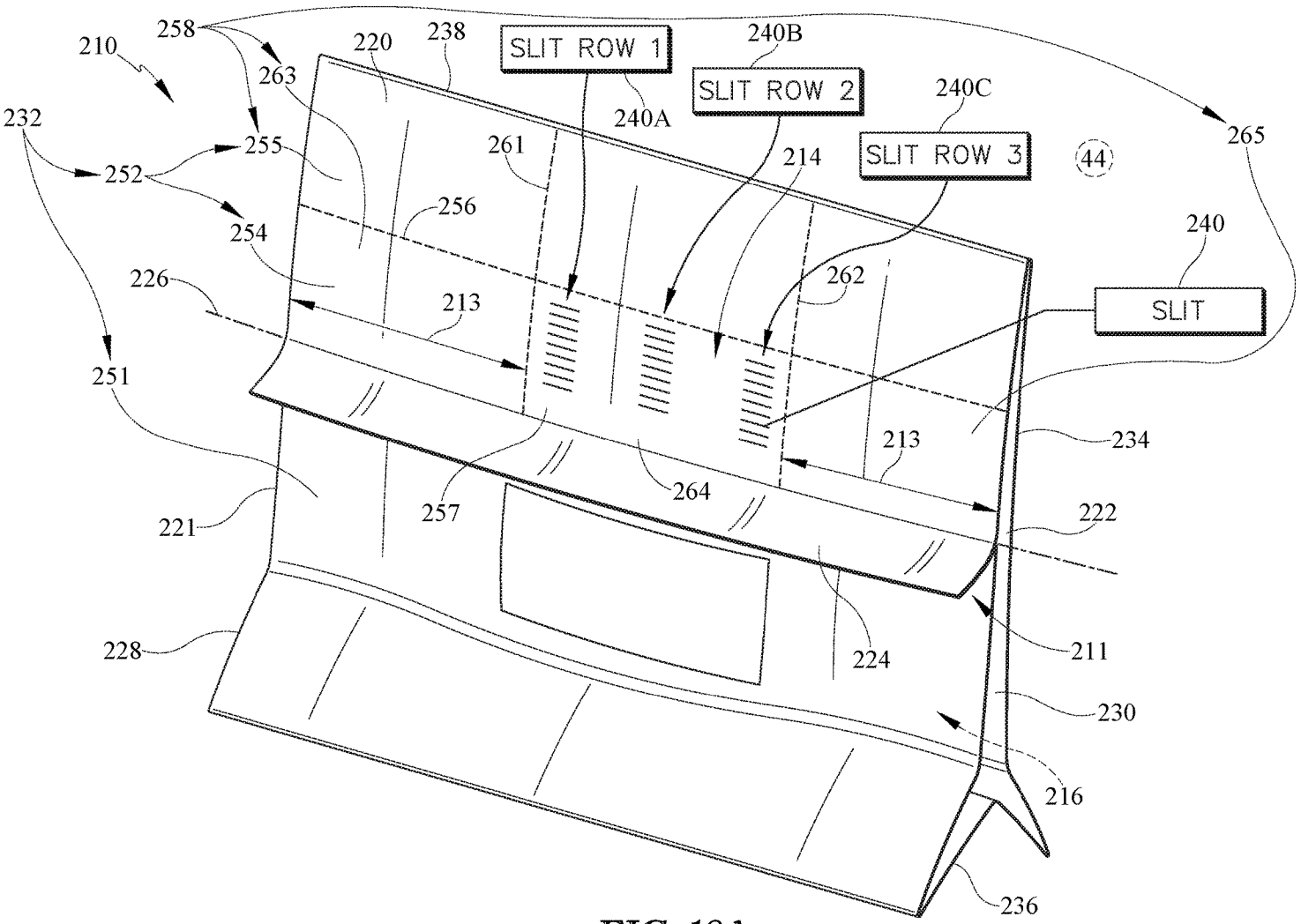
Figure 18B:
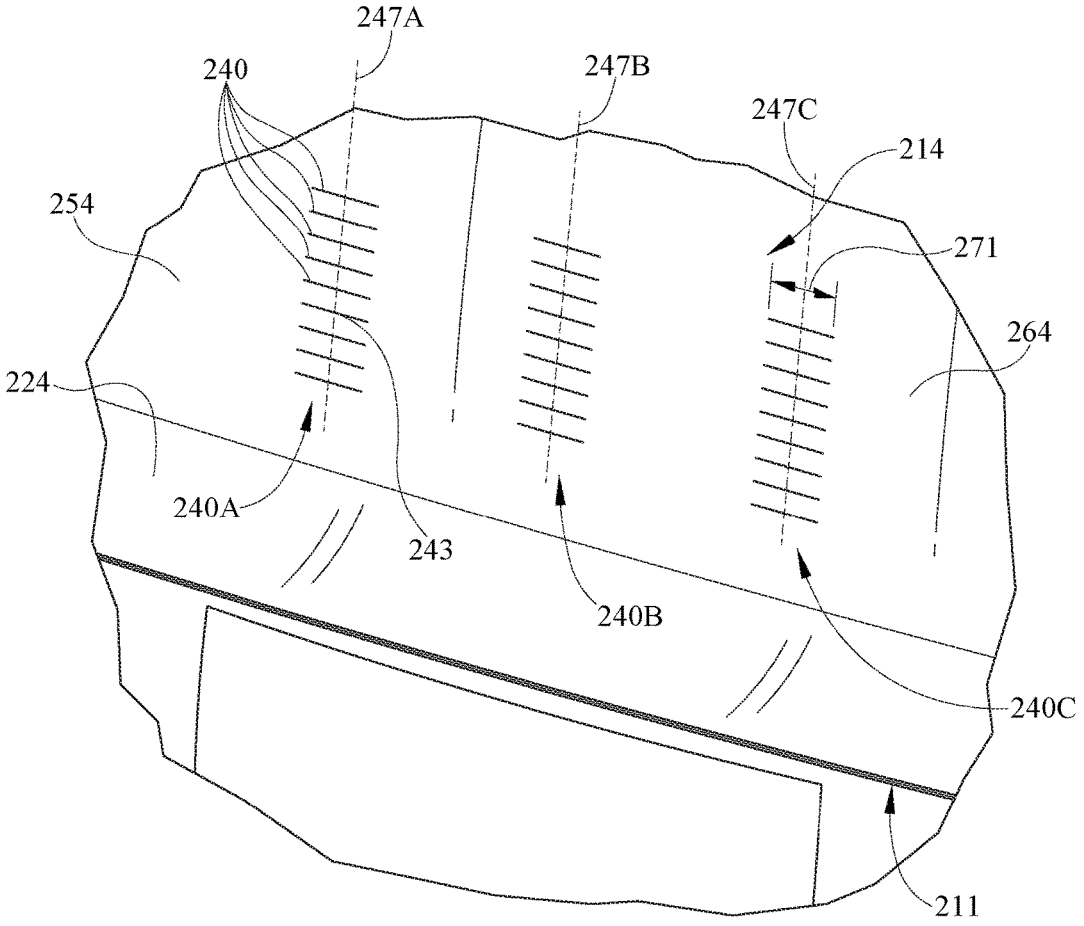
Figure 19:
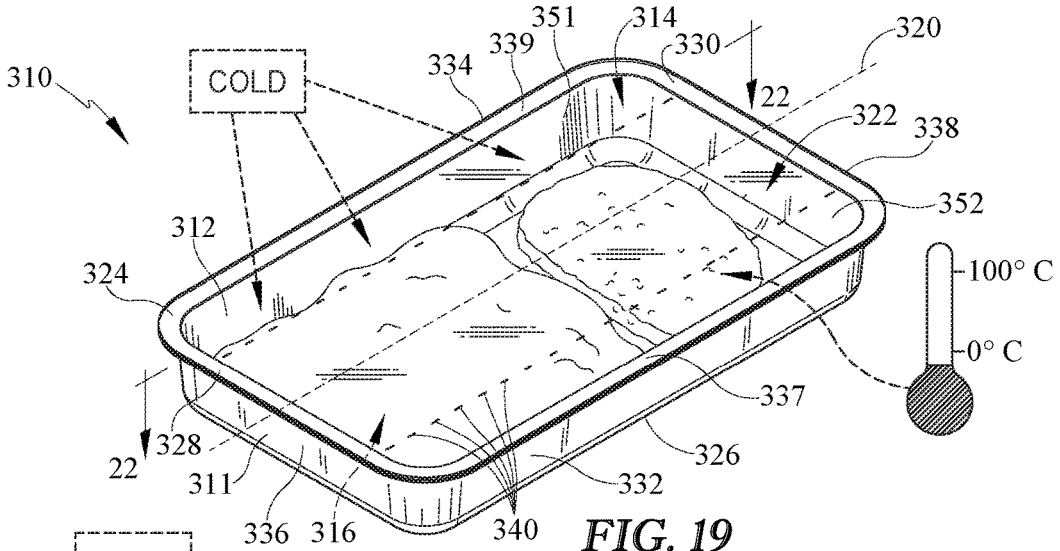
Figure 20:
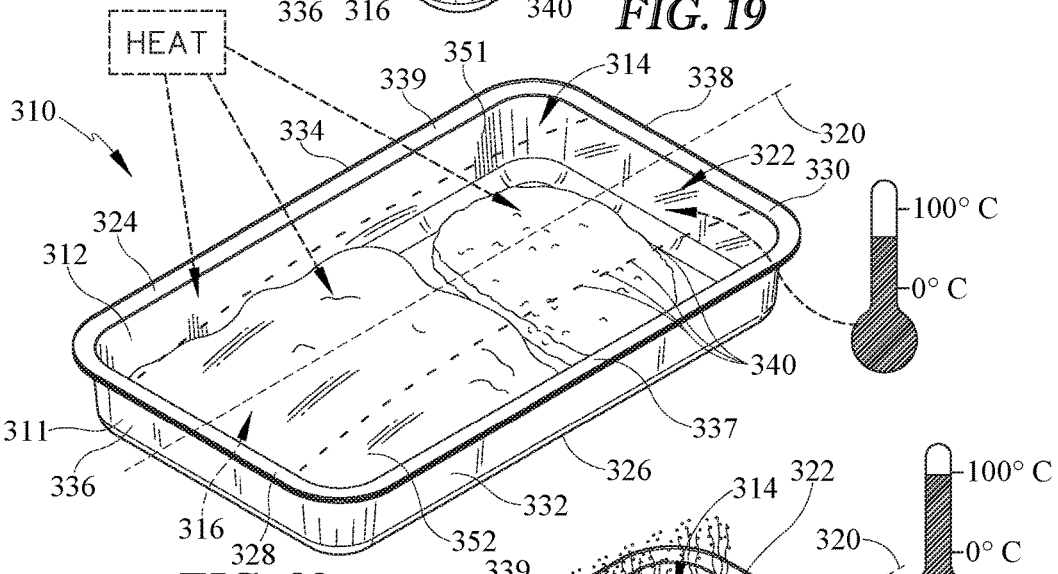
Figure 21:
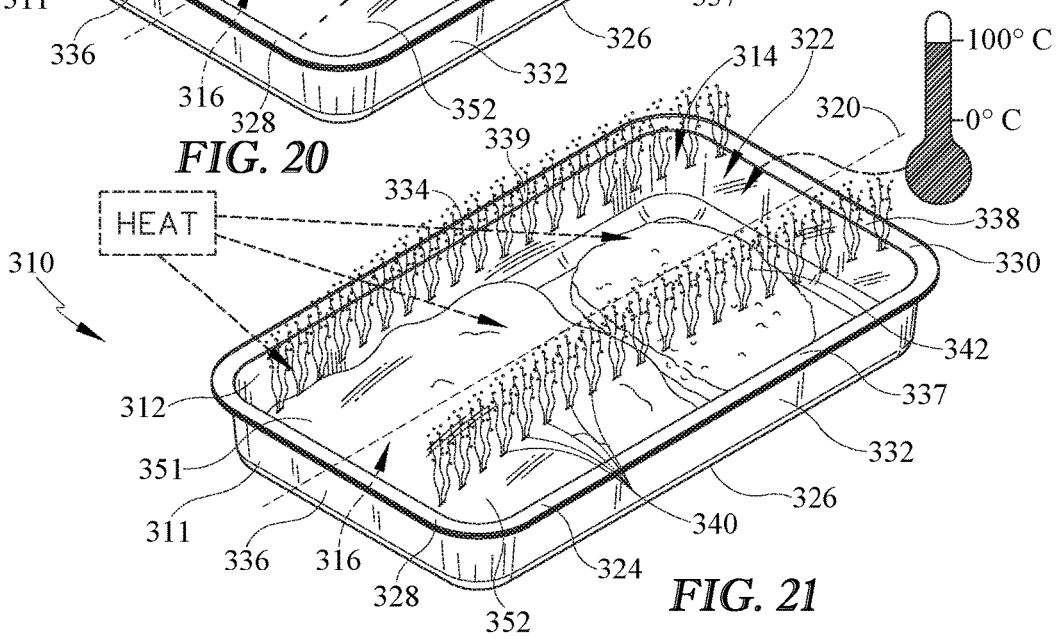
Figure 22:
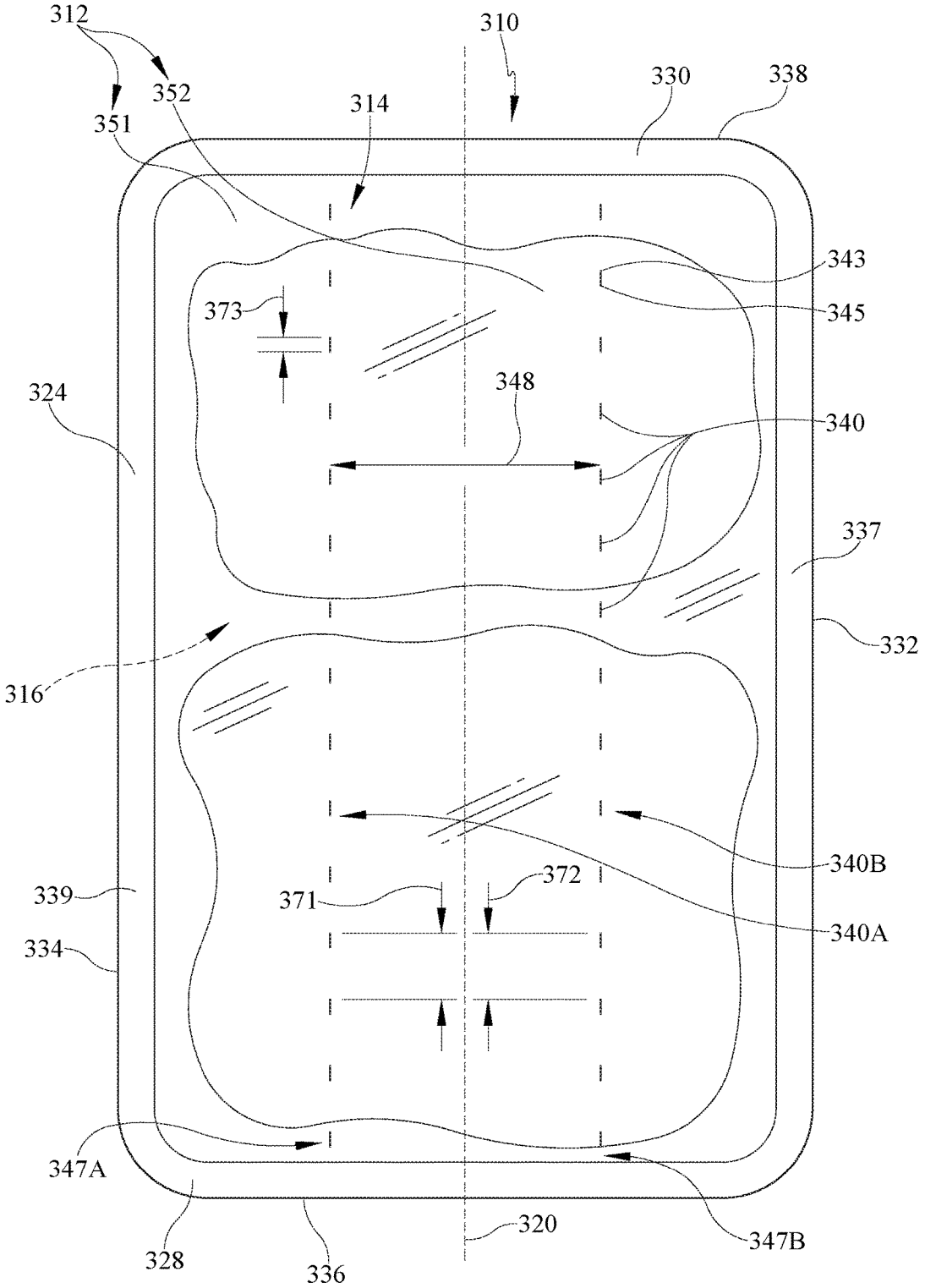
Figure 23:
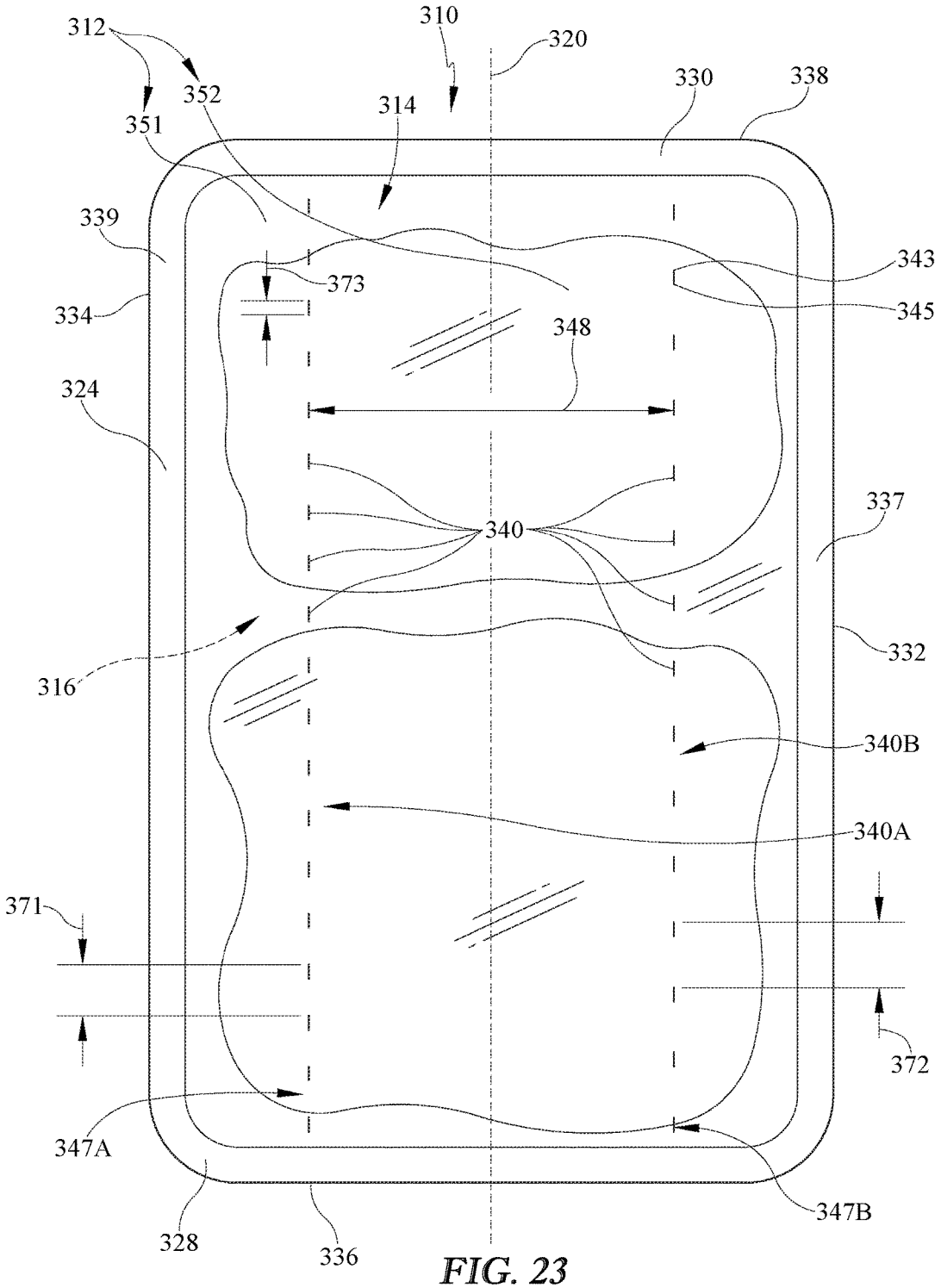
Figure 24:
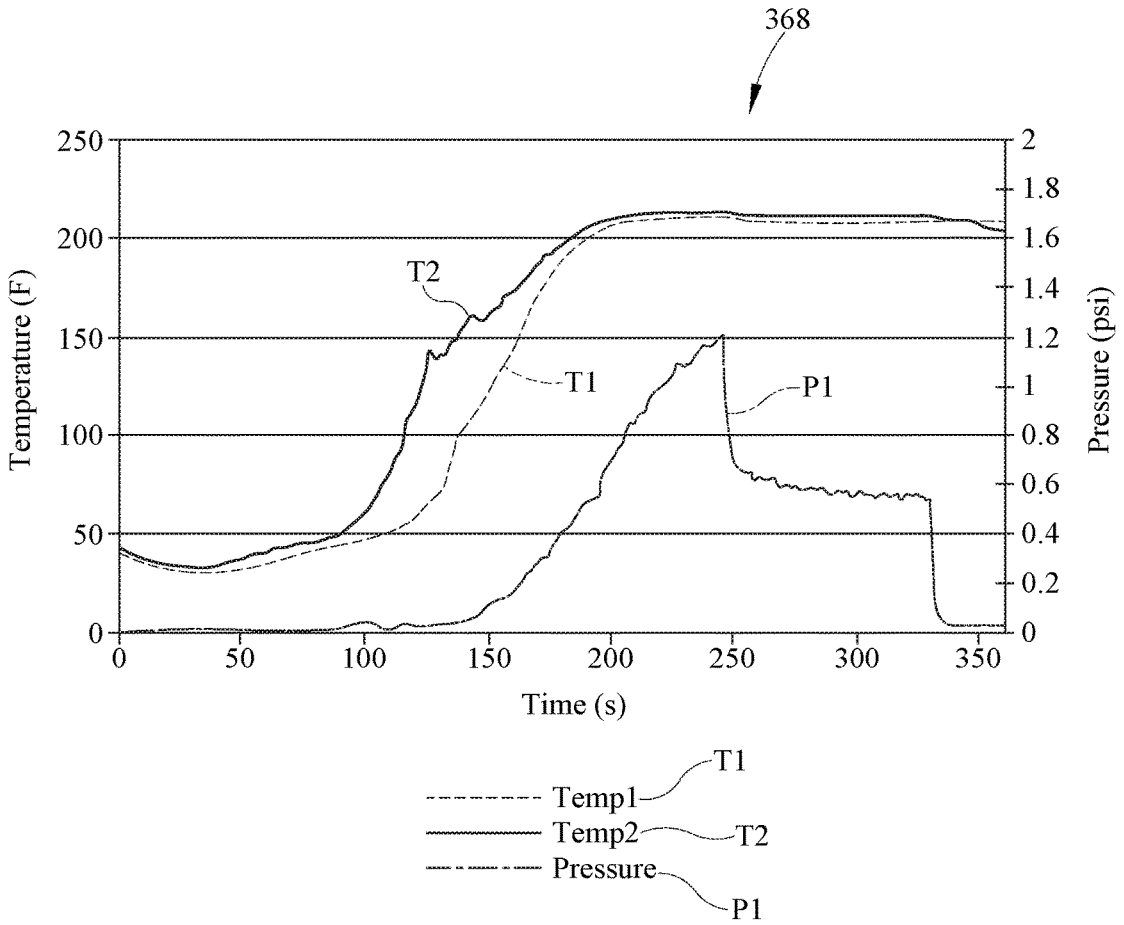
Figure 29:
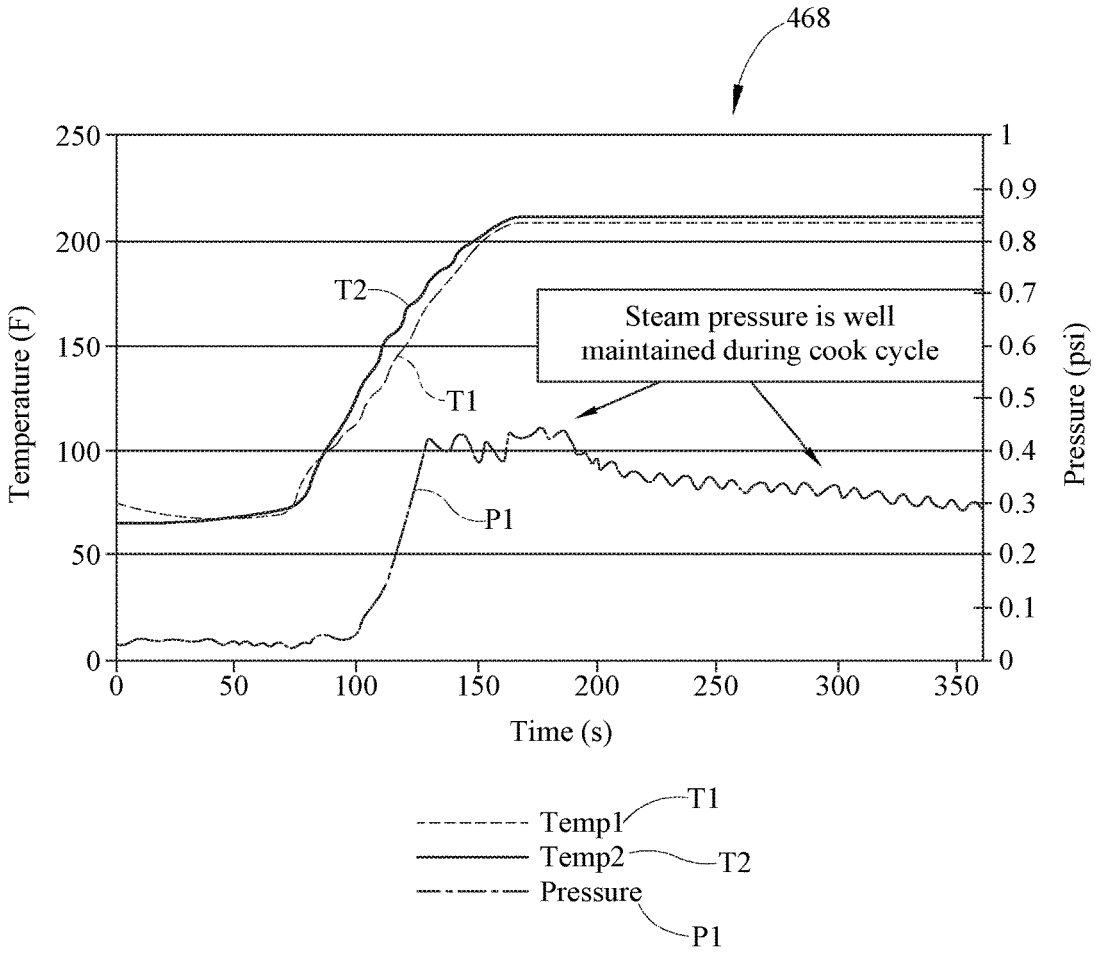

FIG. 3 is a view similar to FIG. 2 showing that the package has continued to be exposed to heat which has caused the temperature in the interior region to increase further as shown by the thermometer bar to the right of the package, causes steam to be formed in the interior region that causes the pillow container to bulge upwardly, and causes steam to escape in a controlled manner through the steam-venting system;

FIG. 4A is an enlarged perspective view of the package of FIG. 1 showing the steam-venting system includes, for example, three rows of slits spaced apart from each other and including short and long slits, the steam-venting system being located in a top wall of the package in an inner portion or strip of the panel located near a seal-fin of the package, the steam-venting system also being located in a section of the strip not near an end of the package;

FIG. 4B is an enlarged partial perspective view of a portion of FIG. 1 with portions broken away to reveal the steam-venting system formed in the pillow container includes an array of various-length slits that are cut into a cold-durable, heat-resistant film during container forming as suggested in FIG. 6;

FIG. 5 is a graph showing how pressure and temperature change during heating of the package of FIGS. 1-4A;

FIG. 6 is a partial perspective view of a container-forming process moving from left to right showing that the container-forming process begins with unrolling a roll of cold-durable, heat-resistant film formed to include the steam-venting system, providing the cold-durable, heat-resistant film to a filler machine in which first and second sides of the cold-durable, heat-resistant film are brought together and mated to one another to form a seal fin so that a product-receiving passageway is established through which product is placed into an interior region after a lower end seal is established and before an upper end seal is established as suggested in FIG. 7;

FIG. 7 is a plan view of the container formed using the illustrative container-forming process shown in FIG. 6 showing that the steam-venting system is formed in the cold-durable, heat-resistant film so that a portion of the steam-venting system is arranged to lie under the fin seal;

FIG. 8 is an enlarged partial perspective view of a portion of the cold-durable, heat-resistant film showing that steam-venting system includes a first column of vents having various lengths cut into the film, a second column of vents having various lengths cut into the film, and a third column of vents having various lengths cut into the film;

FIGS. 9-11 are a series of views showing a second embodiment of a package including a double-gusset container and a second embodiment of a steam-venting system formed in the double-gusset container to allow steam to escape in a controlled manner from an interior region formed in the double-gusset container during heating of the package;

FIG. 9 is a perspective view of the package undergoing freezing showing that the package is subjected to below freezing temperatures as indicated by a thermometer bar to the right of the package that shows a below-freezing temperature of air in the interior region formed in the double-gusset container;

FIG. 10 is a view similar to FIG. 9 showing that the package is being exposed to heat which causes the temperature in the interior region to increase as shown by the thermometer bar to the right of the package and causes air to expand in the double-gusset container causing the container to bulge upwardly;

FIG. 11 is a view similar to FIG. 10 showing that the package has continued to be exposed to heat which has caused the temperature in the interior region to increase further as shown by the thermometer bar to the right of the package, causes steam to be formed in the interior region that causes the double-gusset container to bulge upwardly, and causes steam to escape in a controlled manner through the steam-venting system formed in the double-gusset container;

FIG. 12A is an enlarged perspective view of the package of FIG. 9 showing the steam-venting system includes, for example, three rows of slits spaced apart from each other and including equal-length slits, the steam-venting system being located in a top wall of the package in an inner portion or strip of the panel located near a seal-fin of the package, the steam-venting system also being located in a section of the strip not near an end of the package;

FIG. 12B is an enlarged partial perspective view of a portion of FIG. 9 with portions broken away to reveal the steam-venting system formed in the double-gusset container includes an array of equal-length slits that are cut into a cold-durable, heat-resistant film during container forming;

FIG. 13 is a graph showing how pressure and temperature change during heating of the package of FIGS. 9-12A;

FIG. 14 is an enlarged partial perspective view of a portion of the cold-durable, heat-resistant film showing that steam-venting system includes a first column of vents having equal lengths cut into the film, a second column of vents having equal lengths cut into the film, and a third column of vents having equal lengths cut into the film;

FIGS. 15-17 are a series of views showing a third embodiment of a package including a single-gusset container and a steam-venting system formed in the single-gusset container to allow steam to escape in a controlled manner from an interior region formed in the single-gusset container during heating of the package;

FIG. 15 is a perspective view of the package undergoing freezing showing that the package is subjected to below freezing temperatures as indicated by a thermometer bar to the right of the package that shows a below-freezing temperature of air in the interior region formed in the single-gusset container;

FIG. 16 is a view similar to FIG. 15 showing that the package is being exposed to heat which causes the temperature in the interior region to increase as shown by the thermometer bar to the right of the package and causes air to expand in the single-gusset container causing the container to bulge outwardly;

FIG. 17 is a view similar to FIG. 16 showing that the package has continued to be exposed to heat which has caused the temperature in the interior region to increase further as shown by the thermometer bar to the right of the package, causes steam to be formed in the interior region that causes the single-gusset container to bulge outwardly, and causes steam to escape in a controlled manner through the steam-venting system formed in the single-gusset container;

FIG. 18A is an enlarged perspective view of the package of FIG. 15 showing the steam-venting system includes, for example, three rows of slits spaced apart from each other and including equal-length slits, the steam-venting system being located in a top wall of the package in an inner portion or strip of the panel located near a seal-fin of the package, the steam-venting system also being located in a section of the strip not near an end of the package;

FIG. 18B is an enlarged partial perspective view of a portion of FIG. 15 showing that the steam-venting system is formed in the single-gusset container above the seal fin so that liquids formed during heating are blocked from leaking through the steam-venting system during heating;

FIGS. 19-21 are a series of views showing a fourth embodiment of a package including a rectangular container and a closure formed from a cold-durable, heat-resistant, peelable film undergoing freezing as suggested in FIG. 19, undergoing heating as suggested in FIG. 20, and undergoing continued heating and venting as suggested in FIG. 21;

FIG. 19 is a perspective view of a package undergoing freezing showing that the rectangular container and the closure are subjected to below freezing temperatures as indicated by a thermometer bar to the right of the package that shows a below-freezing temperature of air in an interior region formed between the container and the closure;

FIG. 20 is a perspective view of the package of FIG. 19 showing that the package is being exposed to heat which causes the temperature in the interior region to increase as shown by the thermometer bar to the right of the package and causes air to expand in the rectangular container causing the closure to bulge outwardly;

FIG. 21 is a view similar to FIG. 20 showing that the package has continued to be exposed to heat which has caused the temperature in the interior region to increase further as shown by the thermometer bar to the right of the package, causes steam to be formed in the interior region that causes the closure to bulge outwardly, and causes steam to escape in a controlled manner through the steam-venting system formed in the closure;

FIG. 22 is a plan view taken from the perspective of line 22-22 of FIG. 19 showing that the steam-venting system includes a first column of vents spaced apart equally from one another and a second column of vents spaced apart the same amount as the first column of vents;

FIG. 23 is a plan view of another embodiment of a steam-venting system formed in a closure showing that the steam-venting system includes a first column of vents spaced apart from one another a first distance and a second column of vents spaced apart from one another a different second distance;

FIG. 24 is a graph showing how pressure and temperature change during heating of the package of FIGS. 19-21;

FIGS. 25-27 are a series of views showing a fifth embodiment of a package including a rectangular container and a closure formed from a cold-durable, heat-resistant, peelable film undergoing freezing as suggested in FIG. 25, undergoing heating as suggested in FIG. 26, and undergoing continued heating and venting as suggested in FIG. 27;

FIG. 25 is a perspective view of another embodiment of a package undergoing freezing showing that the rectangular container and the closure are subjected to below freezing temperatures as indicated by the thermometer bar to the right of the package that shows a below-freezing temperature of air in an interior region formed between the container and the closure;

FIG. 26 is a view similar to FIG. 25 showing that the steam-venting system forms in the package as steam pressure applies a sufficient force (Fup) to the closure to cause a portion of the closure to separate from an annular brim included in the container to cause a steam passageway to be established between the closure and the brim so that steam pressure and temperature in the interior region are controlled during heating;

FIG. 27 is a view similar to FIG. 26 showing opening of the package which occurs after heating has ceased and the temperature in the interior region has had time to decrease, as shown by the thermometer bar to the right of the package, and showing that as the temperature falls, the amount of steam escaping from the steam-venting system decreases and a user is able to apply a sideways pulling force to the closure to cause the closure to peel back from a brim included in the container to open the interior region;

FIG. 28 is an enlarged partial perspective view of the steam-venting system of FIG. 26; and FIG. 29 is a graph showing how pressure and temperature change during heating of the package of FIGS. 25-27.

DETAILED DESCRIPTION

A package 10 in accordance with the present disclosure includes a container 12 and a steam-venting system 14 as shown, for example, in FIGS. 1-3. Container 12 is formed to include an interior region 16 in which products may be stored for use at a later time. As an example, food products are placed in interior region 16 at a facility during forming of container 12. Container 12 and food products are then frozen for storage as suggested, for example, in FIG. 1. Food products are then heated, for example by a microwave oven, as suggested in FIG. 2. During heating, steam 42 is generated in interior region 16 and conducted through steam-venting system 14 in a controlled manner so that temperature and pressure generated in interior region 16 is controlled, as shown, for example, in FIG. 3 and suggested in FIG. 5.

Package 10 in accordance with a first embodiment of the present disclosure includes a pillow container 12 and a seal fin 24 as shown in FIGS. 1-4A. Seal fin 24 is coupled to pillow container 12 along a seal-fin line 26 as shown, for example, in FIGS. 1-4A. Pillow container 12 is formed to include interior region 16 and is formed to include steam-venting means 14 for venting steam formed in interior region 16 during heating in a controlled manner to cause temperature and pressure generated in interior region 16 to be maximized without causing an unintended opening to be formed in pillow container 12 during heating.

Pillow container 12 includes, for example, a first end 28, an opposite second end 30, a first edge 36, and an opposite second edge 38 as shown in FIGS. 1-4A. Opposite second end 30 is spaced apart from first end 28. First edge 36 is arranged to extend between and interconnect first and second ends 28, 30. Second edge 38 is spaced apart from first edge 36 and is arranged to extend between and interconnect first and second ends 28, 30 as shown in FIG. 4A.

Pillow container 12 further includes a sleeve 20 including a top wall 32 and a bottom wall 34, as shown in FIGS. 1-4A. Bottom wall 34 is coupled to top wall 32 to form interior region 16 therebetween. Top wall 32 extends between first and second ends 28, 30 and first and second edges 36, 38. Bottom wall 34 extends between first and second ends 28, 30 and first and second edges 36, 38. As shown in FIG. 1, seal fin 24 is coupled to top wall 32 along seal-fin line 26 and is arranged to extend away from seal-fin line 26 toward first edge 36 of pillow container 12.

Steam venting means 14 includes first, second, and third rows 40A, 40B, 40C of one or more slits 40 formed in top wall 32, as shown in FIGS. 4A and 4B. Rows 40A, 40B, and 40C of slits 40 allow steam 42 to travel from interior region 16 into a surrounding atmosphere 44 outside of pillow container 12. Steam-venting means 14 is an opened steam-venting system that is configured to provide means for controlling pressure P and temperature T in interior region 16 during heating of package 10 to cause steam 42 to be generated in interior region 16 and conducted through sleeve 20 so that food products stored in interior region 16 are heated uniformly throughout, as illustrated, for example, in FIGS. 1-3.

As illustrated in FIGS. 1-4B, first row 40A of slits 40 is located in top wall 32 of pillow container 12. Second row 40B of slits 40 is also located in top wall 32 and is spaced apart from and in parallel alignment with first row 40A of slits 40. Third row 40C of slits 40 is also located in top wall 32 and is spaced apart from and in parallel alignment with both first row 40A and second row 40B. In an illustrative example, each slit 40 in first, second, and third rows 40A, 40B, and 40C have a length which is generally parallel to seal-fin line 26.

Each slit 40 includes a midpoint 43 arranged to lie on a midpoint line 47 as illustrated, for example, in FIG. 4B. Each midpoint 43 of each slit 40 in first row 40A is arranged to lie on a first-row midpoint line 47A. Each midpoint 43 of each slit 40 in second row 40B is arranged to lie on a second-row midpoint line 47B. Each midpoint 43 of each slit 40 in third row 40C is arranged to lie on third-row midpoint line 47C. Lines 47A, 47B, and 47C are arranged to lie generally parallel to first and second ends 28, 30 and perpendicular to seal-fin line 26. Slits 40 in rows 40A, 40B, and 40C are arranged to lie generally perpendicular to midpoint lines 47A, 47B, and 47C and generally parallel to seal-fin line 26.

As shown in FIGS. 4A, 4B, and 8, first row 40A includes a first pattern 70A of slits 40. First pattern 70A includes slits 40 with a first length 71 and a second length 72, with second length 72 being shorter than first length 71. First pattern 70A includes, for example, in order from closest to seal-fin line 26 to furthest from seal-fin line 26, first, second, third, fourth, fifth, and sixth short slits 721, 722, 723, 724, 725, 726 with second length 72, a first long slit 711 with first length 71, seventh and eighth short slits 727, 728 with second length 72, a second long slit 712 with first length 71, and a ninth short slit 729 with second length 72. As shown in FIG. 4B, third row 40C has a third pattern 70C which is substantially similar to first pattern 70A. As an example, first length 71 is about 4 millimeters and second length 72 is about 2 millimeters.

Second row 40B includes a second pattern 70B of slits 40. Second pattern 70B includes slits 40 with first length 71 and second length 72. Second pattern 70B includes, for example, in order from closest to seal-fin line 26 to furthest from seal-fin line 26, first, second, third, fourth, and fifth short slits 721, 722, 723, 724, 725 with second length 72, a first long slit 711 with first length 71, sixth and seventh short slits 726, 727 with second length 72, a second long slit 712 with first length 71, and eighth and ninth short slits 728, 729 with second length 72. Patterns 70A, 70B, and 70C are configured to regulate the amount of steam 42 venting through steam-venting system 14 during heating such that temperature and pressure generated in interior region 16 is maximized without causing an unintended opening in the package 10.

As shown in FIGS. 1-4B, steam-venting system 14 is formed in top wall 32. Seal fin 24 and bottom wall 34 cooperate to form a space 11 therebetween as shown in FIGS. 4A and 4B. Steam-venting means 14 is formed in top wall 32 and a portion of steam-venting means 14 lies in space 11 as shown in FIG. 4B.

Top wall 32 of pillow container 12 includes, for example, a first panel 51 and a second panel 52, as shown in FIG. 4A. First panel 51 extends between first end 28, first edge 36, second end 30, and seal-fin line 26. Second panel 52 extends between first end 28, second edge 38, second end 30, and seal-fin line 26. Steam-venting system 14 is, for example, in first panel 51 of top wall 32.

First panel 51 includes an inner strip 54, an outer strip 55, and a panel-partition line 56 positioned to lie between inner strip 54 and outer strip 55, as illustrated in FIG. 4A. Outer strip 55 lies between inner strip 54 and first edge 36. Inner strip 54 lies between outer strip 55 and seal-fin line 26. Steam-venting system 14 is formed, for example, in inner strip 54 of first panel 51 as shown in FIG. 4A.

Inner strip 54 is divided into first, second, and third inner-strip sections 63, 64, 65 by first and second strip-division lines 61, 62, as shown in FIG. 4A. First and second strip-division lines 61, 62 extend from first edge 36 to seal-fin line 26. In illustrative embodiments, first and second strip-division lines 61, 62 are generally parallel to one another and are generally parallel to first and second ends 28, 30 of container 12. As an example, first-strip division line 61 is spaced apart from first end 28 by a distance 13 and second strip-division line 62 is spaced apart from second end 30 of sleeve 20 by distance 13 as shown in FIG. 4A.

As illustrated in FIG. 4A, first inner-strip section 63 lies between second inner-strip section 64 and first end 28. Second inner-strip section 64 lies between first inner-strip section 63 and third inner-strip section 65. Third inner-strip section 65 lies between second inner-strip section 64 and second end 30. As an example, first, second, and third inner-strip sections 63, 64, and 65 are substantially the same size. However, first, second, and third inner strip sections 63, 64, and 65 may have varying shapes and sizes. As shown, for example, in FIG. 4A, steam-venting system 14 is located in second inner-strip section 64. Steam-venting means 14 is positioned on second inner-strip section 64 such that a portion of steam-venting means 14 lies between seal fin 24 and bottom wall 34 of package 10 in space 11.

In another example, first panel 51 includes a U-shaped outer field 58 and an inner field 57, as illustrated in FIG. 4A. U-shaped outer field 58 and second panel 52 cooperate to surround inner field 57. Steam-venting system 14 is formed, for example, in inner field 57. Steam-venting means 14 is positioned on inner field 57 such that a portion of steam-venting means 14 lies between seal fin 24 and bottom wall 34 of package 10 in space 11.

Steam venting system 14 includes, for example, first, second, and third rows 40A, 40B, and 40C of slits 40 as shown in FIGS. 1-4B. Each slit 40 allows steam 42 to travel from interior region 16 through top wall 32 and into surrounding atmosphere 44. During an initial stage of heating, heat is applied to package 10 causing temperature T in interior region 16 to increase as measured by thermometer bar 17, as illustrated, for example, in FIG. 2. Heating causes steam 42 to be created as temperature and pressure in interior region 16 increases, as illustrated in FIGS. 2-3. Steam 42 creates pressure on container 12 forcing top wall 32 to expand upward away from bottom wall 34 as shown in FIG. 3. As steam 42 applies force to top wall 32, some steam 42 moves through slits 40. As heating continues, steam 42 continues to build in interior region 16 while also venting at an increased rate through slits 40 into surrounding atmosphere 44, as shown in FIG. 3. As a result, pressure and temperature in interior region 16 are controlled so that food products are heated uniformly throughout without causing an unintended opening to be formed in the container during heating.

During heating, temperatures T1, T2 and pressure P1 change in interior region 16 over time. Graph 68 shows how a first temperature T1, a second temperature T2, and pressure P1 in interior region 16 of package 10 changes during heating with the use of steam-venting system 14. As suggested in FIG. 5, steam-venting system 14 allows temperatures and pressures in interior region 16 to increase until steam 42 is generated and conducted through slits 40 of steam-venting system 14 formed in container 12. Once steam 42 begins to move through slits 40, pressure is controlled so that temperatures remain generally stable as heating continues. As a result, pressure is maximized without causing an unintended opening to be formed in container 12 during heating.

As illustrated in FIGS. 6-7, package 10 that includes a pillow container 12 and a seal fin 24 may be formed, filled, and sealed using illustrative packaging equipment 80, such as, but not limited to, a vertical or horizontal form, fill-and-seal machine. Steam venting means 14 may be formed into a roll of plastic film 82 prior to plastic film 82 being loaded on packaging equipment 80. Steam-venting means 14 can be positioned or located on plastic film 82 such that it will be located between seal fine 24 and bottom wall 34 of package 10 once package 10 is fully formed, filled, and sealed.

As illustrated in FIGS. 1-4A, rows 40A, 40B, and 40C of slits 40 may be spaced apart from one another and from first end 28, second end 30, first edge 36, and second edge 38 of sleeve 20. Slits 40 may be formed in sleeve 20 prior to formation of package 10. In one exemplary embodiment, slits 40 are formed by a razor or knife blade piercing sleeve 20. However, any other suitable alternatives may be used.

As illustrated in FIG. 8, first-row midpoint line 47A and second-row midpoint line 47B of rows 40A and 40B are spaced apart from one another by a first-row width 75. Second-row midpoint line 47B and the third-row midpoint line 47C are spaced apart from one another by a second-row width 76. As an example, first-row width 75 and second-row width 76 are both about 1 inch.

First slit 721 of row 40A is spaced apart from a film edge 125 by a first-row length 73 as shown in FIG. 8. First slit 721 of row 40C is also spaced apart from film edge 125 by first-row length 73. First slit 721 of row 40B is spaced apart from film edge 125 by a second-row length 74. As an example, first-row length 73 is about ½ of an inch and second-row length 74 is about ⅝ of an inch.

Second slit 722 of rows 40A, 40B, 40C are spaced apart from first slit 721 of rows 40A, 40B, 40C by a slit distance 77. Likewise, each slit in rows 40A, 40B, and 40C is separated from its neighboring slit by slit distance 77. As an example, slit distance 77 is about ⅛ of an inch.

Pillow container 12 includes sleeve 20, a first end seal 21, and a second end seal 22, as shown in FIGS. 1-4 and 7. First end seal 21 is formed in sleeve 20 along first end 28 of sleeve 20. Second end seal 22 is spaced apart from and opposite first end seal 21 and is formed along opposite second end 30 of sleeve 20. Seal fin 24 is formed along a longitudinal axis of pillow container 12 and extends between and interconnects first and second end seals 21, 22. Interior region 16 is defined by sleeve 20, first end seal 21, second end seal 22, and seal fin 24. Seal fin 24 is coupled to pillow container 12 along seal-fin line 26 that extends between first end 28 and second end 30. Seal fin 24 is formed by sealing two ends of pillow container 12 together to form sleeve 20.

Top wall 32 and bottom wall 34 of sleeve 20 are connected together at first edge 36 of pillow container 12, second edge 38 of pillow container 12, first end seal 21, and second end seal 22, as shown in FIG. 4. First edge 36 extends between first end 28 and second end 30 of sleeve 20. Similarly, second edge 38 extends between first end 28 and second end 30 of sleeve 20 and is spaced apart from first edge 36. Top wall 32 and bottom wall 34 are therefore defined by first edge 36, first end 28, second edge 38, and second end 30. Seal fin 24 is coupled to top wall 32 of pillow container 12 along seal-fin line 26 and extends away from seal-fin line 26 towards first edge 36 of container 12, as seen in FIGS. 1-4A.

Additional embodiments of the present disclosure are envisioned. Similar elements across additional embodiments are referenced with corresponding numbering for the embodiments.

Package 110 in accordance with another embodiment of the present disclosure includes a double-gusset container 112 and a seal fin 124 as shown in FIGS. 9-12A. Seal fin 124 is coupled to double-gusset container 112 along a seal-fin line 126 as shown, for example, in FIGS. 9-12A. Double-gusset container 112 is formed to include interior region 116 and is formed to include steam-venting means 114 for venting steam formed in interior region 116 during heating in a controlled manner to cause temperature and pressure generated in interior region 116 to be maximized without causing an unintended opening to be formed in double-gusset container 112 during heating.

Double-gusset container 112 includes a first end 128, an opposite second end 130, a first gusset side 136, also called first side wall 136, and an opposite second gusset side 138, also called second side wall 138, as shown in FIGS. 9-12A. Opposite second end 130 is spaced apart from first end 128. First gusset side 136 is arranged to extend between and interconnect first and second ends 128, 130. Second gusset side 138 is spaced apart from first gusset side 136 and is arranged to extend between and interconnect first and second ends 128, 130. First and second gusset sides 136, 138 are configured to expand and fold as shown in FIGS. 9 and 11.

Double-gusset container 112 further includes a sleeve 120 including a top wall 132 and a bottom wall 134, as shown in FIGS. 9-12A. Bottom wall 134 is coupled to top wall 132 to form interior region 116 therebetween. Top wall 132 extends between first and second ends 128, 130 and first and second gusset sides 136, 138. Bottom wall 134 extends between first and second ends 128, 130 and first and second gusset sides 136, 138. First and second gusset sides 136, 138 extend between and interconnect top wall 132 and bottom wall 134. As shown in FIGS. 9-12A, seal fin 124 is coupled to top wall 132 along seal-fin line 126 and is arranged to extend away from seal-fin line 126 toward first gusset side 136 of double-gusset container 112.

Steam venting means 114 includes first, second, and third rows 140A, 140B, 140C of one or more slits 140 formed in top wall 132, as shown in FIGS. 12A and 12B. Rows 140A, 140B, and 140C of slits 140 allow steam 142 to travel from interior region 116 into a surrounding atmosphere 144 outside of double-gusset container 112. Steam venting means 114 is an opened steam-venting system that is configured to provide means for controlling pressure P and temperature T in interior region 116 during heating of package 110 to cause steam 142 to be generated in interior region 116 and conducted through sleeve 120 so that food products stored in interior region 116 is heated uniformly throughout, as illustrated, for example, in FIGS. 9-11.

As illustrated in FIGS. 9-12B, first row 140A of slits 140 is formed in top wall 132 of double-gusset container 112. Second row 140B of slits 140 is also formed in top wall 132 and is spaced apart from and in parallel alignment with first row 140A of slits 140. Third row 140C of slits 140 is also formed in top wall 132 and is spaced apart from and in parallel alignment with both first row 140A and second row 140B. In an illustrative example, each slit 140 in first, second, and third rows 140A, 140B, and 140C has a length that is generally parallel to seal-fin line 126.

Each slit 140 includes a midpoint 143 arranged to lie on a midpoint line 147 as illustrated, for example in FIG. 12B. Each midpoint 143 of each slit 140 in first row 140A is arranged to lie on a first-row midpoint line 147A. Each midpoint 143 of each slit 140 in second row 140B is arranged to lie on a second-row midpoint line 147B. Each midpoint 143 of each slit 140 in third row 140C is arranged to lie on third-row midpoint line 147C. Lines 147A, 147B, 147C are arranged to lie generally parallel to first and second ends 128, 130 and perpendicular to seal-fin line 126. Slits 140 in rows 140A, 140B, and 140C are arranged to lie generally perpendicular to midpoint lines 147A, 147B, and 147C and generally parallel to seal-fin line 126.

In an illustrative embodiment, first row 140A, second row 140B, and third row 140C are arranged to include slits 140 with substantially a length 171 that is generally the same as every other slit 140 in rows 140A, 140B, and 140C. Length 171 and arrangement of slits 140 in rows 140A, 140B, and 140C is configured to regulate the amount of steam 142 venting through steam-venting system 114 during heating such that temperature and pressure generated in interior region 116 are maximized without causing an unintended opening in the package 110. As an example, length 171 is about 4 millimeters. In another example, length 171 may be about 2 millimeters.

As shown in FIGS. 9-12B, steam-venting system 114 is formed in top wall 132. Seal fin 124 and bottom wall 134 cooperate to form a space 111 therebetween as shown in FIGS. 12A and 12B. Steam-venting means 114 is formed in top wall 132 and a portion of steam-venting means 114 lies in space 111 as shown in FIG. 12B.

Top wall 132 of double-gusset container 112 includes, for example, a first panel 151 and a second panel 152, as shown in FIG. 12A. First panel 151 extends between first end 128, first gusset side 136, second end 130, and seal-fin line 126. Second panel 152 extends between first end 128, second gusset side 138, second end 130, and seal-fin line 126. Steam-venting system 114 is, for example, in first panel 151 of top wall 132.

First panel 151 includes an inner strip 154, an outer strip 155, and a panel-partition line 156 positioned to lie between inner strip 154 and outer strip 155, as illustrated in FIG. 12A. Outer strip 155 lies between inner strip 154 and first gusset side 136. Inner strip 154 lies between outer strip 155 and seal-fin line 126. Steam-venting system 114 is formed, for example, in inner strip 154 of first panel 151 as shown in FIG. 12A.

Inner strip 154 is divided into first, second, and third inner-strip sections 163, 164, 165 by first and second strip-division lines 161, 162 as shown in FIG. 12A. First and second strip-division lines 161, 162 extend from first gusset side 136 to seal-fin line 126. In illustrative embodiments, first and second strip-division lines 161, 162 are generally parallel to one another and are generally parallel to first and second ends 128, 130 of container 112. As an example, first-strip division line 161 is spaced apart from first end 128 by a distance 113 and second strip-division line 162 is spaced apart from second end 130 of sleeve 120 by distance 113 as shown in FIG. 12A.

As illustrated in FIG. 12A, first inner-strip section 163 lies between second inner-strip section 164 and first end 128. Second inner-strip section 164 lies between first inner-strip section 163 and third inner-strip section 165. Third inner-strip section 165 lies between second inner-strip section 164 and second end 130. As an example, first, second, and third inner-strip sections 163, 164, and 165 are substantially the same size. However, first, second, and third inner strip sections 163, 164, and 165 may have varying shapes and sizes. As shown, for example, in FIG. 12A, steam-venting system 114 is located in second inner-strip section 164.

Steam-venting means 114 is positioned on second inner-strip section 164 such that a portion of steam-venting means 114 lies between seal fin 124 and bottom wall 134 of package 110 in space 111.

In another example, first panel 151 includes a U-shaped outer field 158 and an inner field 157, as illustrated in FIG. 12A. U-shaped outer field 158 and second panel 152 cooperate to surround inner field 157. Steam-venting system 114 is formed, for example, in inner field 157. Steam-venting means 114 is formed in inner field 157 such that a portion of steam-venting means 114 lies between seal fin 124 and bottom wall 134 of package 110 in space 111.

Steam venting system 114 includes, for example, first, second, and third rows 140A, 140B, and 140C of slits 140 as shown in FIGS. 9-12B. Each slit 140 allows steam 142 to travel from interior region 116 through top wall 132 and into surrounding atmosphere 144. During an initial stage of heating, heat is applied to package 110 causing temperature T in interior region 116 to increase as measured by thermometer bar 117, as illustrated, for example, in FIG. 10. Heating causes steam 142 to be created as temperature and pressure in interior region 116 increase, as illustrated in FIGS. 10-11. Steam 142 creates pressure on container 112 forcing top wall 132 to expand upward away from bottom wall 134 and to cause first and second gusset sides 136, 138 to expand and unfold as shown in FIGS. 10 and 11. As steam 142 applies force to top wall 132, some steam 142 moves through slits 140. As heating continues, steam 142 continues to build in interior region 116 while also venting at an increased rate through slits 140 into surrounding atmosphere 144 as shown in FIG. 11. As a result, pressure and temperature in interior region 116 are controlled so that food products are heated uniformly throughout without causing an unintended opening to be formed in the container during heating.

During heating, temperatures T1, T2 and pressure P1 change in interior region 116 over time. As shown in FIG. 13, graph 168 shows how a first temperature T1, a second temperature T2, and pressure P1 in interior region 116 of package 110 changes during heating with the use of steam-venting system 114. As suggested in FIG. 13, steam-venting system 114 allows temperatures and pressures in interior region 116 to increase until steam 142 is generated and conducted through slits 140 of steam-venting system 114 formed in container 112. Once steam 142 begins to move through slits 140, pressure is controlled so that temperatures remain generally stable as heating continues. As a result, pressure is maximized without causing an unintended opening to be formed in container 112 during heating.

Package 110 includes double-gusset container 112 and seal fin 124 that may be formed, filled, and sealed using packaging equipment as suggested in FIG. 6. Steam venting means 114 may be formed into a roll of plastic film prior to plastic film being loaded onto double-gusset container 112 by packaging equipment as suggested in FIG. 14.

As illustrated in FIGS. 9-12A, rows 140A, 140B, and 140C of slits 140 may be spaced apart from one another and from first end 128, second end 130, first gusset side 136, and second gusset side 138 of sleeve 120. Slits 140 may be formed in sleeve 120 prior to formation of package 110. In one exemplary embodiment, slits 140 are formed by a razor or knife blade piercing sleeve 120. However, any other suitable alternative device may be used.

As illustrated in FIG. 14, first-row midpoint line 147A and the second-row midpoint line 147B of rows 140A and 140B are spaced apart from one another by a first-row width 175. Second-row midpoint line 147B and the third-row midpoint line 147C are spaced apart from one another by a second-row width 176. As an example, first-row width 175 and second-row width 176 are both about 1.5 inches.

First slit 721 of row 140A is spaced apart from a film edge 125 by a first-row length 173. First slit 721 of row 140C is also spaced apart from film edge 125 by first-row length 173. First slit 721 of row 140B is spaced apart from film edge 125 by a second-row length 174. As an example, first-row length 173 is about ⅝ of an inch and second-row length 174 is about ¾ of an inch.

Fourth slit 724 of row 140B is spaced apart from third slit 723 of row 140B by a slit distance 177. Likewise, each slit in rows 140A, 140B, and 140C is separated by its neighboring slit by slit distance 177. As an example, slit spacer distance 177 is about ⅛ inch.

Double-gusset container 112 includes sleeve 120, a first end seal 121, and a second end seal 122, as shown in FIGS. 9-12. First end seal 121 is formed in sleeve 120 along first end 128 of sleeve 120. Second end seal 122 is spaced apart from and opposite first end seal 121 and is formed along opposite second end 130 of sleeve 120. Seal fin 124 is formed along a longitudinal axis of double-gusset container 112 and extends between and interconnects first and second end seals 121, 122. Interior region 116 is defined by sleeve 120, first end seal 121, second end seal 122, and seal fin 124. Seal fin 124 is coupled to double-gusset container 112 along seal-fin line 126 that extends between first end 128 and second end 130. Seal fin 124 is formed by sealing two ends of double-gusset container 112 together to form sleeve 120.

Top wall 132 and bottom wall 134 of sleeve 120 are connected together at first gusset side 136 of double-gusset container 112, second gusset side 138 of double-gusset container 112, first end seal 121, and second end seal 122, as shown in FIG. 12A. First gusset side 136 extends between first end 128 and second end 130 of sleeve 120. Similarly, second gusset side 138 extends between first end 128 and second end 130 of sleeve 120 and is spaced apart from first gusset side 136. Top wall 132 and bottom wall 134 are therefore defined by first gusset side 136, first end 128, second gusset side 138, and second end 130. Seal fin 124 is coupled to top wall 132 of double-gusset container 112 along seal-fin line 126 and extends away from seal-fin line 126 towards first gusset side 136 of container 112, as seen in FIGS. 9-12A.

Package 210 in accordance with another embodiment of the present disclosure includes a single-gusset container 212 and a seal fin 224 as shown in FIGS. 15-18A. Seal fin 224 is coupled to single-gusset container 212 along a seal-fin line 226 as shown, for example, in FIGS. 15-18A. Single-gusset container 212 is formed to include interior region 216 and is formed to include steam-venting means 214 for venting steam formed in interior region 216 during heating in a controlled manner to cause temperature and pressure generated in interior region 216 to be maximized without causing an unintended opening to be formed in single-gusset container 212 during heating.

Single-gusset container 212 includes a first expandable side 228, an opposite second expandable side 230, a gusset bottom 236, and an opposite top edge 238 as shown in FIGS. 15-18A. Opposite second expandable side 230 is spaced apart from first expandable side 228. Gusset bottom 236 is arranged to extend between and interconnect first and second expandable sides 228, 230. Top edge 238 is spaced apart from gusset bottom 236 and is arranged to extend between and interconnect first and second expandable side 228, 230. Gusset bottom 236 is configured to expand and fold as suggested in FIGS. 15-17.

Single-gusset container 212 further includes a sleeve 220 including a front wall 232 and a back wall 234, as shown in FIGS. 15-18A. Back wall 234 is coupled to front wall 232 to form interior region 216 therebetween. Front wall 232 extends between first and second expandable sides 228, 230 and also extends between gusset bottom 236 and top edge 238. Back wall 234 extends between first and second expandable sides 228, 230 and also extends between gusset bottom 236 and top edge 238. Gusset bottom 236 and top edge 238 extend between and interconnect front wall 232 and back wall 234. As shown in FIGS. 15-18A, seal fin 224 is coupled to front wall 232 along seal-fin line 226 and is arranged to extend away from seal-fin line 226 toward gusset bottom 236 of single-gusset container 212.

Steam venting means 214 includes first, second, and third rows 240A, 240B, 240C of slits 240 formed in front wall 232, as shown in FIGS. 18A and 18B. Rows 240A, 240B, and 240C of slits 240 allow steam 242 to travel from interior region 216 into a surrounding atmosphere 244 outside of single-gusset container 212. Steam-venting means 214 is an opened steam-venting system that is configured to provide means for controlling pressure P and temperature T in interior region 216 during heating of package 210 to cause steam 242 to be generated in interior region 216 and conducted through sleeve 220 so that food products stored in interior region 216 is heated uniformly throughout, as illustrated, for example, in FIGS. 15-17.

As illustrated in FIGS. 15-18B, first row 240A of slits 240 is located in front wall 232 of single-gusset container 212. Second row 240B of slits 240 is also located in front wall 232 and is spaced apart from and in parallel alignment with first row 240A of slits 240. Third row 240C of slits 240 is also located in front wall 232 and is spaced apart from and in parallel alignment with both first row 240A and second row 240B. In an illustrative example, each slit 240 in first, second, and third rows 240A, 240B, and 240C of slits 240 have a length that is generally parallel to seal-fin line 226.

Each slit 240 includes a midpoint 243 arranged to lie on a midpoint line 247 as illustrated, for example, in FIG. 18B. Each midpoint 243 of each slit 240 in first row 240A is arranged to lie on a first-row midpoint line 247A. Each midpoint 243 of each slit 240 in second row 240B is arranged to lie on a second-row midpoint line 247B. Each midpoint 243 of each slit 240 in third row 240C is arranged to lie on third-row midpoint line 247C. Lines 247A, 247B, 247C are arranged to lie generally parallel to first and second expandable sides 228, 230 and perpendicular to seal-fin line 226. Slits 240 in rows 240A, 240B, and 240C are arranged to lie generally perpendicular to midpoint lines 247A, 247B, and 247C and generally parallel to seal-fin line 226.

In an illustrative embodiment, first row 240A, second row 240B, and third row 240C are arranged to include slits 240 with length 271. Length 271 and arrangement of slits 240 in rows 240A, 240B, and 240C is configured to regulate the amount of steam 242 venting through steam-venting system 214 during heating such that temperature and pressure generated in interior region 216 is maximized without causing an unintended opening in the package 210. As an example, length 271 is about 4 millimeters.

As shown in FIGS. 15-18B, steam-venting system 214 is formed in front wall 232. Seal fin 224 and back wall 234 cooperate to form a space 211 therebetween as shown in FIGS. 18A and 18B. Steam-venting means 214 is formed in front wall 232 to lie outside of space 211 as shown in FIG. 18B.

Front wall 232 of single-gusset container 212 includes, for example, a first panel 251 and a second panel 252, as shown in FIG. 18A. First panel 251 extends between first expandable side 228, gusset bottom 236, second expandable side 230, and seal-fin line 226. Second panel 252 extends between first expandable side 228, top edge 238, second expandable side 230, and seal-fin line 226. Steam-venting system 214 is, for example, in second panel 252 of front wall 232.

Second panel 252 includes an inner strip 254, an outer strip 255, and a panel-partition line 256 positioned to lie between inner strip 254 and outer strip 255, as illustrated in FIG. 18A. Outer strip 255 lies between inner strip 254 and top edge 238. Inner strip 254 lies between outer strip 255 and seal-fin line 226. Steam-venting system 214 is formed, for example, in inner strip 254 of second panel 252 as shown in FIG. 18A.

Inner strip 254 is divided into first, second, and third inner-strip sections 263, 264, 265 by first and second strip-division lines 261, 262, as shown in FIG. 18A. First and second strip-division lines 261, 262 extend from top edge 238 to seal-fin line 226. In illustrative embodiments, first and second strip-division lines 261, 262 are generally parallel to one another and are generally parallel to first and second expandable sides 228, 230 of container 212. As an example, first-strip division line 261 is spaced apart from first expandable side 228 by a distance 213 and second strip-division line 262 is spaced apart from second expandable side 230 of sleeve 220 by distance 213 as shown in FIG. 18A.

As illustrated in FIG. 18A, first inner-strip section 263 lies between second inner-strip section 264 and first expandable side 228. Second inner-strip section 264 lies between first inner-strip section 263 and third inner-strip section 265. Third inner-strip section 265 lies between second inner-strip section 264 and second expandable side 230. As an example, first, second, and third inner-strip sections 263, 264, and 265 are substantially the same size. However, first, second, and third inner strip sections 263, 264, and 265 may have varying shapes and sizes. As shown, for example, in FIG. 18A, steam-venting system 214 is located in second inner-strip section 264. Steam-venting means 214 is positioned on second inner-strip section 264 such that no portion of steam-venting means 214 lies between seal fin 224 and back wall 234 of package 210 in space 211.

In another example, second panel 252 includes a U-shaped outer field 258 and an inner field 257, as illustrated in FIG. 18A. U-shaped outer field 258 and first panel 251 cooperate to surround inner field 257. Steam-venting system 214 is formed, for example, in inner field 257. Steam-venting means 214 is positioned on inner field 257 such that no portion of steam-venting means 214 lies between seal fin 224 and back wall 234 of package 210 in space 211.

Steam venting system 214 includes, for example, first, second, and third rows 240A, 240B, and 240C of slits 240 as shown in FIGS. 15-18B. Each slit 240 allows steam 242 to travel from interior region 216 through front wall 232 and into surrounding atmosphere 244. During an initial stage of heating, heat is applied to package 210 causing temperature T in interior region 216 to increase as measured by thermometer bar 217, as illustrated, for example, in FIG. 16. Heating causes steam 242 to be created as temperature and pressure in interior region 216 increases, as illustrated in FIGS. 16-17. Steam 242 creates pressure on container 212 forcing front wall 232 to expand outwardly in a direction away from back wall 234 as shown in FIG. 17. As steam 242 applies force to front wall 232, some steam 242 moves through slits 240. As heating continues, steam 242 continues to build in interior region 216 while also venting at an increased rate through slits 240 into surrounding atmosphere 244, as shown in FIG. 17. As a result, pressure and temperature in interior region 216 are controlled so that food products are heated uniformly throughout without causing an unintended opening to be formed in the container during heating.

Steam venting system 214 allows temperatures and pressures in interior region 216 to increase until steam 242 is generated and conducted through slits 240 of steam-venting system 214 formed in container 212. Once steam 242 begins to move through slits 240, pressure is controlled so that temperatures remain generally stable as heating continues. As a result, pressure is maximized without causing an unintended opening to be formed in container 212 during heating.

Package 210 includes a single-gusset container 212 and a seal fin 224 that may be formed, filled, and sealed using packaging equipment as suggested in FIG. 10. Steam venting means 214 may be formed into a roll of plastic film prior to plastic film being formed into single-gusset container 212 by packaging equipment.

As illustrated in FIGS. 15-18A, rows 240A, 240B, and 240C of slits 240 may be spaced apart from one another and from first expandable side 228, second expandable side 230, gusset bottom 236, and top edge 238 of sleeve 220. Slits 240 may be formed in sleeve 220 prior to formation of package 210. In one exemplary embodiment, slits 240 are formed by a razor or knife blade piercing sleeve 220. However, any other suitable alternative may be used.

Single-gusset container 212 includes sleeve 220, a first end seal 221, and a second end seal 222, as shown in FIGS. 15-18. First end seal 221 is formed in sleeve 220 along first expandable side 228 of sleeve 220. Second end seal 222 is spaced apart from and opposite first end seal 221 and is formed along opposite second expandable side 230 of sleeve 220. Seal fin 224 is formed along a longitudinal axis of single-gusset container 212 and extends between and interconnects first and second end seals 221, 222. Interior region 216 is defined by sleeve 220, first end seal 221, second end seal 222, and seal fin 224. Seal fin 224 is coupled to single-gusset container 212 along seal-fin line 226 that extends between first expandable side 228 and second expandable side 230. Seal fin 224 is formed by sealing two ends of single-gusset container 212 together to form sleeve 220.

Front wall 232 and back wall 234 of sleeve 220 are connected together at gusset bottom 236, top edge 238, first end seal 221, and second end seal 222, as shown in FIG. 18. Gusset bottom 236 extends between first expandable side 228 and second expandable side 230 of sleeve 220. Similarly, top edge 238 extends between first expandable side 228 and second expandable side 230 of sleeve 220 and is spaced apart from gusset bottom 236. Front wall 232 and back wall 234 are therefore defined by gusset bottom 236, first expandable side 228, top edge 238, and second expandable side 230. Seal fin 224 is coupled to front wall 232 of single-gusset container 212 along seal-fin line 226 and extends away from seal-fin line 226 towards gusset bottom 236 of container 212, as seen in FIGS. 15-18A.

Package 310 in accordance with another embodiment of the present disclosure includes a closure 312 and a container 311 as shown in FIGS. 19-21. Closure 312 and container 311 are coupled together to form an interior region 316 therebetween. As illustrated in FIGS. 19-21, closure 312 is formed to include steam-venting means 314 for venting steam formed in interior region 316 during heating in a controlled manner to cause temperature and pressure generated in interior region 316 to be maximized without causing an unintended opening to be formed in package 310 during heating.

Closure 312 may be formed from a peelable film or other similar material and includes a first edge 328 and an opposite second edge 330. First edge 328 is spaced apart from second edge 330 and steam-venting means 314 extends from first edge 328 to second edge 330 as illustrated in FIGS. 19-21. Closure 312 also includes a closure-partition line 320 that extends from first edge 328 to second edge 330.

Container 311 includes a base 326, first side wall 336, an opposite second side wall 338, a front wall 332, and an opposite back wall 334. Base 326 is coupled to first side wall 336, opposite second side wall 338, front wall 332, and opposite back wall 334. First side wall 336 is spaced apart from second side wall 338. Front wall 332 is spaced apart from back wall 334. Both first side wall 336 and second side wall 338 extend between and interconnect front wall 332 and back wall 334. Base 326, first side wall 336, opposite second side wall 338, front wall 332, and opposite back wall 334 cooperate with closure 312 to define interior region 316.

Closure 312 is coupled to an annular brim 324 of container 311 which is coupled to first side wall 336, opposite second side wall 338, front wall 332, and opposite back wall 334 to define a mouth opening 322 into interior region 316. As shown in FIGS. 19-21, first edge 328 and second edge 330 of closure 312 couple to first side wall 336 and second side wall 338, respectively. Further, a front edge 337 and a back edge 339 of closure 312 couple to front wall 332 and back wall 334, respectively. First edge 328 and second edge 330 extend between and interconnect front edge 337 and back edge 339.

Steam venting means 314 includes first and second rows 340A and 340B of slits 340 formed in closure 312 as shown in FIGS. 19-23. Slits 340 have a slit length 373 of about 2 millimeters. Rows 340A and 340B of slits 340 allow steam 342 to travel from interior region 316 into a surrounding atmosphere 344 outside of closure 312. Steam venting means 314 is an opened steam-venting system 314 that is configured to provide means for controlling pressure P and temperature T in interior region 316 during heating of package 310 to cause steam 342 to be generated in interior region 316 and conducted through closure 312 so that food products stored in interior region 316 is heated uniformly throughout, as illustrated, for example, in FIGS. 19-21.

As illustrated in FIGS. 19-23, first row 340A of slits 340 is formed in closure 312. Second row 340B of slits 340 is also formed in closure 312 and is spaced apart from and generally parallel to first row 340A of slits 340. In an illustrative example, first and second rows 340A and 340B of slits 340 are formed generally perpendicular to first edge 328 and second edge 330 of closure 312.

Each slit 340 includes a front point 343 and a back point 345, with front and back points arranged to lie on a row line 347 as illustrated, for example, in FIGS. 22-23. Each front and back point 343, 345 of each slit 340 in first row 340A is arranged to lie on a first-row line 347A. Each front and back points 343,345 of each slit 340 in second row 340B is arranged to lie on a second-row line 347B. Lines 347A and 347B are arranged to lie generally parallel to front edge 337 and back edge 339 and perpendicular to first edge 328 and second edge 330. Slits 340 in rows 340A and 340B are arranged to lie generally parallel to row lines 347A and 347B and generally parallel to partition line 320.

In an illustrative embodiment, first row 340A is arranged to include a first length 371 between the front points 343 of each slit 340 in row 340A. Second row 340B is arranged to include a second length 372 between the front points 343 of each slit 340 in row 340B. As an example, first length 371 and second length 372 may be substantially the same size, for example, about 1 inch, as shown in FIG. 22. However, first length 371 and second length 372 may have varying sizes, for example, first length 371 may be about ¾ of an inch and second length 372 may be about 1 inch, as illustrated in FIG. 23. Length 371 and length 372 are configured to regulate the amount of steam 342 venting through steam-venting system 314 during heating such that temperature and pressure generated in interior region 316 is maximized without causing an unintended opening in the package 310.

First-row line 347A and second-row line 347B are separated by row spacer 348. As an example, in an embodiment where first length 371 and second length 372 are substantially the same size, row spacer 348 is about 52 millimeters, as illustrated in FIG. 22. Where first length 371 and 372 have varying sizes, row spacer 348 is about 71 millimeters, as illustrated in FIG. 23. It should be understood that as the container sizes change, the first and second lengths may change in accordance with the present disclosure.

Closure 312 includes, for example, a first film panel 351 and a second film panel 352 established by closure-partition line 320 as shown in FIG. 22. First film panel 351 extends between first edge 328, back edge 339, second edge 330, and closure-partition line 320. Second film panel 352 extends between first edge 328, front edge 337, second edge 330 and closure-partition line 320. Steam-venting system 314 is located, for example, in both first film panel 351 and second film panel 352 of closure 312. As an example, first row 340A of steam-venting system 314 may be located in first film panel 351 and second row 340B of steam-venting system 314 may be located in second film panel 352, as suggested in FIGS. 19-22. As shown in FIGS. 19-22, first and second panels 351, 352 may have about the same size and shape. However, first and second panels in accordance with the present disclosure may have varying shapes and sizes.

Steam venting system 314 includes, for example, first and second rows 340A and 340B of slits 340 as shown in FIGS. 19-22. Each slit 340 allows steam 342 to travel from interior region 316 through closure 312 and into surrounding atmosphere 344. During an initial stage of heating, heat is applied to package 310 causing temperature T in interior region 316 to increase as measured by thermometer bar 217, as illustrated, for example, in FIG. 20. Heating causes steam 342 to be created as temperature and pressure in interior region 316 increases as illustrated in FIGS. 20-21. Steam 342 creates pressure on package 310 forcing closure 312 to expand outwardly in a direction away from container 311 as shown in FIG. 21. As steam 342 applies force to closure 312, some steam 342 moves through slits 340. As heating continues, steam 342 continues to build in interior region 316 while also venting at an increased rate through slits 340 into surrounding atmosphere 344 as shown in FIG. 21. As a result, pressure and temperature in interior region 316 are controlled so that food products are heated uniformly throughout without causing an unintended opening to be formed in the container during heating.

During heating, temperatures T1, T2 and pressure P1 change in interior region 316 over time. Graph 368 shows how a first temperature T1, a second temperature T2, and pressure P1 in interior region 316 of package 310 changes during heating with the use of steam-venting system 314. As suggested in FIG. 24, steam-venting system 314 allows temperatures and pressures in interior region 316 to increase until steam 342 is generated and conducted through slits 340 of steam-venting system 314 formed in closure 312. Once steam 342 begins to move through slits 340, pressure is controlled so that temperatures remain generally controlled as heating continues. As a result, pressure is maximized without causing an unintended opening to be formed in package 310 during heating.

As illustrated in FIGS. 19-23, rows 340A and 340B of slits 340 may be spaced apart from one another, from front edge 337, and back edge 339. Slits 340 may be formed in closure 312 prior to formation of package 310. In one exemplary embodiment, slits 340 are formed by a razor or knife blade piercing closure 312. However, any other suitable alternatives may be used.

Package 410 in accordance with another embodiment of the present disclosure includes a closure 412 and a container 411 as shown in FIGS. 25-27. Closure 412 and container 411 are coupled together to form an interior region 416 therebetween. As illustrated in FIGS. 25-27, closure 412 and container 411 cooperate to establish steam-venting means 414 for venting steam formed in interior region 416 during heating in a controlled manner to cause temperature and pressure in interior region 416 to be maximized without causing an unintended opening to be formed in package 410 during heating.

Container 411 includes a base 426, first side wall 436, an opposite second side wall 438, a front wall 432, and an opposite back wall 434. Base 426 is coupled to first side wall 436, opposite second side wall 438, front wall 432, and opposite back wall 434. First side wall 436 is spaced apart from second side wall 438. Front wall 432 is spaced apart from back wall 434. Both first side wall 436 and second side wall 438 extend between and interconnect front wall 432 and back wall 434. Base 426, first side wall 436, opposite second side wall 438, front wall 432, and opposite back wall 434 cooperate with closure 412 to define interior region 416 therebetween.

Closure 412 is coupled to an annular brim 424 of container 411 which is coupled to first side wall 436, opposite second side wall 438, front wall 432, and opposite back wall 434 to define a mouth opening 422 into interior region 416. As shown in FIGS. 25-27, closure 412 includes a first edge 428, and an opposite second edge 430 that couple to first side wall 436 and second side wall 438, respectively. Further, closure 412 includes a front edge 437 and a back edge 439 that couple to front wall 432 and back wall 434, respectively. First edge 428 and second edge 430 extend between and interconnect front edge 437 and back edge 439. Closure 412 may be formed from a peelable film or other similar material. Closure 412 is coupled to annular brim 424 of container 411 by a hermetic seal 423.

Steam venting means 414 is formed between closure 412 and container 411 during heating of package 410, as shown in FIGS. 25-28. Steam-venting means 414 forms in package 410 as steam pressure applies a sufficient Fup force 415 to closure 412 to separate closure 412 from brim 424 in container 411, forming an opening or vent 444 that allows steam to escape from interior region 416. As a result, steam pressure and steam temperature in interior region 416 are controlled throughout the heating process as shown in FIG. 29.

As shown in FIGS. 25-28, steam-venting system 414 is a self-venting system that is configured to provide means for controlling pressure P and temperature T in interior region 416 during heating of package 410 to cause steam 442 to be generated in interior region 416 and conducted between closure 412 and container 411 so that package contents stored in interior region 416 are heated uniformly throughout and upward Fup pulling force 415 is optimized so that a steam passageway 450 is formed between closure 412 and container 411. Steam passageway 450 defines opening or vent 444 to allow steam to escape from interior region 416.

As an example, closure 412 may coupled to a substrate included in brim 424 of container 411 by a bonding interface 449. During heating, upward Fup pulling force 415 provided by steam pressure operates to overcome bonding interface 449 so that a portion of closure 412 separates from brim 424 and steam passageway 450 is established. Thus, steam-venting system 414 is different from steam-venting systems 14, 114, 214, and 314 in that steam-venting system 414 is not formed in a closure, but formed instead between a closure and a container.

As an example of an embodiment of a self-venting system in use, FIG. 29 shows a graph 468 of heating a package including the self-venting system with steam-venting means 414. Graph 468 shows how a first temperature T1, a second temperature T2, and a pressure P1 in interior region 416 of package 410 changes during heating. As can be seen in FIG. 29, the self-venting system 414 allows temperatures and pressures in the interior region 416 to increase until steam 442 is generated and conducted through steam passageway 450 formed between closure 412 and brim 424 of container 411. Once steam 442 begins to move through steam passageway 450, pressure is controlled so that temperatures remain generally controlled as heating continues.

Steam passageway 450 may, for example, be formed at a point where a first portion 461 of hermetic seal 423 requires a first force 471 to overcome first portion 461 of hermetic seal 423 to separate closure 412 from container 411. Second force 472 to overcome a second portion 462 of hermetic seal 423 to separate closure 412 from container 411 may be relatively smaller than first force 471 such that hermetic seal 423 at second portion 462 separates before hermetic seal 423 at first portion 461 when equal force is applied to both first portion 461 and second portion 462.

First and second portions 461, 462 may be located anywhere along first side wall 426, second side wall 438, front wall 432, or back wall 434. For instance, second portion may be located in spaced-apart relationship to a corner 464 of container 411, and first portion 461 may be located between corner 464 of second portion 462 of hermetic seal 423.

Closure 412 also includes a flap 454, as shown, for example, in FIG. 27. Flap 454 may be arranged to extend away from first portion 461 of hermetic seal 423. Flap 454 is configured to provide a means for transferring a sideways pulling force Fsp applied to flap 454 by a user grasping flap 454 and pulling flap 454 in a direction toward the center of container 411 to peel closure 412 away from annular brim 424 and cause hermetic seal 423 to be overcome so that a user may gain access to interior region 416. Flap 454 may be coupled to closure 412, for example, near corner 464. Flap 454 may be coupled to closure 412 in spaced apart relation to second portion 462 of hermetic seal 423, with first portion 461 being located between flap 454 and second portion 462.

Containers 12, 112, 212 and closures 312 and 412 may be made from a film. The film comprises, for example, a multilayer polyolefin sealant layer having at least three sub-layers: (a) an heat sealable sub-layer; (b) a core sub-layer adjacent to heat sealable sub-layer; and (c) an outer skin sub-layer adjacent to core sub-layer such that core sub-layer is sandwiched between heat sealable sub-layer and outer skin sub-layer. In illustrative embodiments, adhesive layer laminates outer skin sub-layer of the multilayer polyolefin sealant layer to protective layer to form cold-durable, heat-resistant, peelable film that has a thickness of about 1 mil to about 10 mil.

Heat sealable sub-layer of the multilayer polyolefin sealant layer is formed from at least one thermoplastic polymer that is capable of heat sealing to itself or to another film layer. In order to make a film suitable for use as packaging for both freezer storage and microwave heating, the inner heat sealable sub-layer of the multilayer film should meet the following requirements: (1) it should have a low heat seal initiation temperature in order to be able to form adequate heat seals on standard packaging machines or form-fill-seal machines (either vertical or horizontal); (2) it should maintain its strength, i.e., not fracture, and have good ductility in subzero freezer temperatures (about −20° C. to about 0° C.); (3) it should be able to maintain sufficient heat seal or control at microwave temperatures (about 71° C. to about 105° C.) without losing control of steam pressure generation, bursting or leaking; and (4) when used as a closure with a container, it should peel easily either before or after microwave cooking, or other cooking, with sideways pulling force Fsp of about 1 lbf/in to about 5 lbf/in. As another example, sideways pulling force Fsp may be about 1 lbf/in to about 3 lbf/in.

Suitable materials for forming heat sealable sub-layer of multilayer polyolefin sealant layers of the present disclosure include, but are not limited to, those that have a seal initiation temperature within the range of from about 105° C. to about 135° C., and melting points within the range of from about 105° C. to about 150° C. As an example, heat sealable sub-layer is formed from at least one propylene/alpha-olefin copolymer. Suitable propylene/alpha-olefin copolymers include propylene/ethylene copolymer, propylene/butene copolymer, propylene/hexene copolymer, propylene/octene copolymer, mixtures thereof, blends thereof, and the like.

As another example, heat sealable sub-layer is formed from at least one propylene/ethylene copolymer (which may be in a random propylene/alpha-olefin copolymer) and at least one polyethylene resin. The polyethylene resin having a melt index of about 0.50 g/10 min. (measured at 190° C. in accordance with ASTM D1238-04) to about 20 g/10 min. (measured at 190° C. in accordance with ASTM D1238-04).

In yet another example, heat sealable sub-layer is formed from at least one propylene/ethylene copolymer (which may be in a random propylene/alpha-olefin copolymer) and two different polyethylene resins one of which has a melt index of about 0.50 g/10 min. (measured at 190° C. in accordance with ASTM D1238-04) to about 20 g/10 min. (measured at 190° C. in accordance with ASTM D1238-04). Suitable polyethylene resins for use herein are, for example, ethylene/octene copolymer (a polyethylene resin derivative also known as a polyolefin elastomer), linear low density polyethylene (LLDPE), low density polyethylene (LDPE), high density polyethylene (HDPE), and polyethylene resin derivatives such as ethylene vinyl acetate, ethylene methyl acrylate, and the like. Suitable propylene/ethylene copolymers for use herein are, for example, polypropylene copolymers comprising from about 1% to about 8% by weight of ethylene comonomer and having a melt flow rate from about 0.5 g/10 min. (measured at 230° C. in accordance with ASTM D1238-04) to about 45 g/10 min. (measured at 230° C. in accordance with ASTM D1238-04).

Without wishing to be bound by theory, it is believed that blending propylene/alpha-olefin copolymer resins (e.g., propylene/ethylene copolymer) with one or more polyethylene resins in heat sealable sub-layer leads to cold-durable, heat-resistant film. The incorporation of ethylene comonomer in the propylene/ethylene copolymer may increase irregularity of the polymer chains which may reduce the crystallinity of the polymer. This may result in a lower seal initiation temperature than if homopolymer polypropylene were used as the heat sealable material, as well as improved ductility at subzero temperatures.

When a frozen, microwaveable packaged food product is cooked in a microwave oven, the steam generated from the food has a temperature close to the boiling point of water, i.e., about 100° C. Under typical microwave cooking conditions, as long as the steam exists in the package, the maximum steam temperature in the package typically remains below 104° C. Polypropylene resins such as Dow H110-02 (melting temperature 161° C.), Dow 6D20 (melting temperature 148° C.), Dow 3000 (melting temperature 108° C.), and Total EOD02 (now Total LX502-15, melting temperature 119° C.), as well as polyethylene terephthalate (PET, melting temperature 230-260° C.) film or polypropylene homopolymer (PP) in an outer protective sub-layer (melting temperature 158-165° C.), each have a melting temperature above 104° C. As such, they can withstand the heat generated during microwave cooking.

Again, without wishing to be bound by theory, steam generated during the course of a microwave cooking cycle is believed to serve the dual purpose of heating a food product and cooling so-called "hot spots" that may develop in the microwaveable package. As stated above, the maximum steam temperature within the package typically remains below 104° C. However, the actual temperature of a food product, in particular those including foods containing, for example, oil(s), sauce(s), sugar(s), starch(es), and the like, may exceed 120° C. (resulting in film scorching and/or film burn-through) if the moisture content of the food product is insufficient to support steam generation that would otherwise provide the aforementioned cooling effect. Thus, the aforementioned exemplary food products are also compatible with the present technology, provided that they maintain a moisture content sufficient for steam generation throughout the microwave cooking cycle.

Dow 8150, Dow 5400G, and Huntsman LD1058 each have a low glass transition temperature (−52° C., <−80° C., and <−80° C., respectively) and thus provide durability in a freezer at subzero temperatures. Dow 5400G and Hunstman LD1058 are polyethylene resins, whereas Dow 8150 is an ethylene-based polyolefin elastomer (i.e., ethylene/octene copolymer). Because of their ethylenic nature, all three of the aforementioned resins have a certain degree of incompatibility with polypropylene resins.

It has been surprisingly found that, under certain heat sealing conditions and/or temperature ranges, the aforementioned incompatibility can be exploited to prepare sealant films that, while maintaining their strength and ductility in subzero freezer temperatures and sufficient heat seal at microwave temperatures, cannot achieve a complete fusion seal with trays or films made from polypropylene resins. Thus, before or after microwaving, the resultant sealant film when prepared as a closure is easily peelable thereby affording cold-durable, heat-resistant, peelable films.

Again, without wishing to be bound by theory, because polypropylene is the major component in heat sealable sub-layer an extrusion (e.g., melt mixing) process is believed, based on microscopic examination, to create a cold-durable, heat-resistant film with polyethylene particles dispersed in the continuous phase of a polypropylene matrix. Due to the aforementioned incompatibility, weak Van der Waals forces rather than strong covalent bonding occur between polyethylene particles and the polypropylene matrix in such a film. Upon stretching such a film, separation of polyethylene particles from the polypropylene matrix occurs resulting in many voids (i.e., gaps or holes) in the peelable film being visible under microscopic examination. Thus, after heat sealing, polyethylene particles bonded to the brim of a polypropylene container by similarly weak forces would be separated easily from the polypropylene, thereby enhancing peelability when used as a closure.

Surprisingly, in spite of a tendency for polyethylene particles to separate from a polypropylene matrix, blending in additional polyethylene resin(s) apparently enhances the adhesive and elastic properties of both the polypropylene and polyethylene phases. As a result, in a hot environment, e.g., at temperatures used in conventional residential microwave ovens (about 71° C. to about 105° C.), a sufficient heat seal may be maintained with a cold-durable, heat-resistant film without bursting, leaking, or unintended opening and losing control of steam pressure generation.

In a cold environment, when an external impact force is applied to a cold-durable, heat-resistant film undesired processes such as plastic deformation, dislocation gliding, polymer crystal twining, and/or polymer chain extension would normally be expected to occur in the polypropylene matrix. Such processes would be expected to result in the formation of cracks, microvoids, and/or creases around the polyethylene particles. Surprisingly, however, polyethylene particles apparently act as energy sinks or crack stoppers to absorb impact energy and inhibit formation and/or propagation of cracks, microvoids and/or creases. Microvoiding and creasing, as well as cracking, are a consequence of the local stress state around polyethylene particles, and are dependent on the adhesion between the polypropylene matrix and polyethylene particles and the elastic properties of both phases. Blending polypropylene resin(s) with one or more polyethylene resin(s) apparently enhances the adhesive and elastic properties of both the polypropylene and polyethylene phases to create a cold-durable, heat-resistant film that maintains its strength, i.e., does not fracture, and has good ductility in subzero freezer temperatures (about 20° C. to about 0° C.).

The thickness of heat sealable sub-layer depends, in part, upon the size of the food package to be made from cold-durable, heat-resistant film. The inner heat sealable sub-layer must be thick enough to form a strong seal that will not fail when exposed to temperatures in a range from about 71° C. to about 105° C., yet not so thick that it negatively affects the manufacture of the sealant layer. In general, the thickness of the heat sealable sub-layer may be in a range from about 0.1 mil to about 3 mils.

The core sub-layer is adjacent to heat sealable sub-layer. Core sub-layers are formed from thermoplastic materials that are compatible with the materials selected for the inner heat sealable sub-layer, and that can form a strong adhesive bond with the heat sealable sub-layer in order to prevent delamination of the sub-layers from occurring during freezer storage and microwave cooking. The core sub-layer should also have a melting point well above microwave cooking temperatures (from about 71° C. to about 105° C.) in order to maintain its solid state and strength when the inner heat sealable sub-layer starts to soften in the microwave.

Examples of materials suitable for use in forming the core sub-layer of the multilayer polyolefin sealant layer include, but are not limited to, polypropylenes or polyethylene resins, blends thereof or mixtures thereof. For example, one example of a material for the core sub-layer is a homopolymer polypropylene having a melt flow rate of about 0.5 g/10 min. (measured at 230° C. in accordance with ASTM D1238-04) to about 25 g/10 min. (measured at 230° C. in accordance with ASTM D1238-04), and a melting point of about 155° C. to about 165° C. Another example of a material for the core sub-layer is an ethylene/octene copolymer (a polyethylene resin derivative also known as a polyolefin elastomer) having a melt index of about 0.5 g/10 min (measured at 190° C. in accordance with ASTM D1238-04 to about 20 g/10 min. (measured at 190° C. in accordance with ASTM D1238-04). An example of a blend or mixture includes homopolymer polypropylene and ethylene/octene copolymer. In general, the thickness of the core sub-layer may range from about 0.1 mil to about 4 mils.

Outer skin sub-layer is adjacent to the core sub-layer. Outer skin sub-layers suitable for use with the present technology are formed from at least one thermoplastic material, and are formed from a blend of thermoplastic materials. Examples of materials suitable for use in forming the outer skin sub-layer of the multilayer polyolefin sealant layer of the present disclosure include, but are not limited to, polypropylene or polyethylene resins, blends thereof, or mixtures thereof. For example, one material for the outer skin sub-layer is a homopolymer polypropylene having a melt flow rate of about 0.5 g/10 min. (measured at 230° C. in accordance with ASTM D1238-04) to about 25 g/10 min. (measured at 230° C. in accordance with ASTM D1238-04), and a melting point of about 155° C. to about 165° C. Another material for the outer skin sub-layer is an ethylene/octene copolymer (a polyethylene resin derivative also known as a polyolefin elastomer) having a melt index of about 0.5 g/10 min (measured at 190° C. in accordance with ASTM D1238-04 to about 20 g/10 min. (measured at 190° C. in accordance with ASTM D1238-04). An example of a blend or mixture includes homopolymer polypropylene and ethylene/octene copolymer. In general, the thickness of the outer skin sub-layer may range from about 0.1 mil to about 4 mils.

Multilayer polyolefin sealant layers of the present technology may be manufactured using a variety of known film processing techniques (e.g., coextrusion, lamination, and the like). For example, a multilayer polyolefin sealant layer of the present technology can be made via a blown film coextrusion process. In such an embodiment, the multilayer sealant layer is formed using a blown film apparatus composed of a multi-manifold circular die head having concentric circular orifices. The multilayer sealant layer is formed by coextruding a molten layer through a circular die, and a molten layer on the other or each opposite side of the first layer through additional circular dies concentric with the first circular die. Next, a gas, typically air, is blown through a jet that is concentric with the circular dies, thereby forming a bubble that expands the individual layers. The bubble is collapsed onto itself to form a pair of multilayer films attached at two opposite edges. Usually, the pair of attached multilayer films are then cut apart at one or more edges and separated into a pair of multilayer films that can be rolled up.

Alternatively, multilayer polyolefin sealant layers of the present technology can be manufactured using other extrusion processes known in the art, such as a cast film process, wherein melted and plasticized streams of individual layer materials are fed into a coextrusion die, such as a multi-manifold die. Upon emersion from the die, the layers are quenched to form a single multilayer film of polymeric material. Multilayer polyolefin sealant films of the present technology can also be manufactured by a lamination process, in which each layer of the film is formed separately, and the layers are then laminated together to arrive at the polyolefin film.

The invention claimed is:

1. A package comprising a container formed to include an interior region and a seal fin coupled to the container along a seal-fin line extending between a first end and an opposite second end of the container, wherein the container is formed to include steam-venting means for venting steam formed in the interior region during heating in a controlled manner to cause temperature and pressure generated in the interior region to be maximized without causing an unintended opening to be formed in the container during heating and wherein the container includes a top wall and a bottom wall coupled to the top wall to form the interior region therebetween, the seal fin is coupled to the top wall along the seal-fin line to extend away from the seal-fin line toward a first edge of the container that extends between first and second ends of the container, the seal fin and the bottom wall cooperate to form a space therebetween, the steam-venting means is formed in the top wall and is exposed on one side of the wall to the interior region and on the other side of the wall is directly exposed to the ambient atmosphere, and a portion of the steam-venting means lies in the space.

2. The package of claim 1, wherein the top wall includes a first panel positioned to lie between the seal-fin line and the first edge of the container and a second panel positioned to lie between the seal-fin line and an opposite second edge of the container that extends between the first and second ends of the container and the steam-venting means is formed in the first panel of the top wall.

3. The package of claim 2, wherein a panel-partition line partitions the first panel to establish an outer strip and an inner strip, the outer strip is positioned to lie between the first edge and the panel-partition line, the inner strip is positioned to lie between the panel-partition line and the seal-fin line, and the steam-venting means is formed in the inner strip.

4. The package of claim 3, wherein first and second strip-division lines divide the inner strip to establish first, second, and third inner-strip sections, the first strip-division line is positioned to lie between the first and second ends of the container, the second strip-division line is positioned to lie between the first strip-division line and the second end of the container, the first inner-strip section is positioned to lie between the first end and the first strip-division line, the second inner-strip section is positioned to lie between the first and second strip-division lines, the third inner-strip section is positioned to lie between the second strip-division line and the second end, and the steam-venting means is formed entirely within the second inner-strip section.

5. The package of claim 4, wherein the first and third inner-strip sections are larger than the second inner-strip section.

6. The package of claim 1, wherein the steam-venting means includes a first row having a first pattern of slits, a second row having a second pattern of slits, and a third row having a third pattern of slits.

7. The package of claim 6, wherein the first pattern of slits is the same as the third pattern of slits.

8. The package of claim 7, wherein the second pattern of slits is different from the first and third patterns of slits.

9. The package of claim 7, wherein the first, second, and third patterns of slits are the same.

10. The package of claim 6, wherein the first, second, and third rows are spaced apart from one another.

11. The package of claim 10, wherein the first row is positioned to lie between the first and second ends of the container, the second row is positioned to lie between the first row and the second end of the container, and the third row is positioned to lie between the second row and the second end of the container.

12. The package of claim 1, wherein the steam-venting means includes a first row having a first pattern of slits and a second row having a second pattern of slits, the first row is positioned to lie between the first and second ends of the container, and the second row is spaced apart from the first row and positioned to lie between the first row and the second end of the container.

13. The package of claim 12, wherein each slit included in the first row has a midpoint and each midpoint is arranged to lie on a first midpoint line that is generally parallel to the first end of the container.

14. The package of claim 13, wherein each slit is arranged to lie generally perpendicular to the first midpoint line.

15. The package of claim 14, wherein a first slit included in the first row has a first slit length and a second slit included in the first row has a relatively longer second slit length.

16. The package of claim 14, wherein all the slits in the first row have relatively the same length.

17. The package of claim 13, wherein each slit included in the second row has a midpoint and each midpoint of the second row is arranged to lie on a second midpoint line that is generally parallel to the first midpoint line.

18. The package of claim 17, wherein each slit of the second row is arranged to lie generally perpendicular to the second midpoint line.

19. The package of claim 18, wherein a first slit included in the first row has a first slit length and a second slit included in the first row has a relatively longer second slit length.

20. The package of claim 18, wherein all the slits in the first row have relatively the same length.

21. The package of claim 12, wherein the first pattern of slits includes, in order, starting closest to the seal-fin line and ending farthest from the seal-fin line, first, second, third, fourth, fifth, and sixth short slits, a first relatively longer slit, seventh and eighth short slits, a second relatively longer slit, and a ninth short slit.

22. The package of claim 21, wherein the first pattern of slits is spaced apart from the seal-fin line a first distance and the second pattern of slits is spaced apart from the seal-fin line a relatively larger second distance.

23. The package of claim 22, wherein the second pattern of slits includes, in order, starting closest to the seal-fin line and ending farthest from the seal-fin line, first, second, third, fourth, and fifth short slits, a first relatively longer slit, sixth and seventh short slits, a second relatively longer slit, and eighth and ninth short slits.

24. A package comprising a container formed to include an interior region, the container including a first end, an opposite second end spaced apart from the first end, a first edge arranged to extend between the first and second ends, and an second edge spaced apart from the first edge and arranged to extend between the first and second ends and a seal fin coupled to the container along a seal-fin line extending between the first and second ends of the container and positioned to lie between the first and second edges of the container, wherein the container is formed to include a steam-venting system that vents steam formed in the interior region during heating in a controlled manner to cause temperature and pressure generated in the interior region to be maximized without causing an unintended opening to be formed in the container during heating and wherein the container includes a top wall and a bottom wall coupled to the top wall to form the interior region therebetween, the seal fin is coupled to the top wall along the seal-fin line to extend away from the seal-fin line towards the first edge of the container, and the steam-venting system is entirely formed in the top wall so that one side of the steam venting system contacts the interior region and the other side of the steam venting system directly contacts the atmosphere.

25. The package of claim 24, wherein the seal-fin line divides the top wall to establish a first panel positioned to lie between the seal-fin line and the first edge and a second panel positioned to lie between the seal-fin line and the second edge and the steam-venting means is formed in the first panel.

26. The package of claim 24, wherein the seal-fin line divides the top wall to establish a first panel positioned to lie between the seal-fin line and the first edge and a second panel positioned to lie between the seal-fin line and the second edge and the steam-venting means is formed entirely within the second panel.

27. The package of claim 24, wherein the steam-venting system includes a first row having a first pattern of slits and a second row having a second pattern of slits and the first pattern of slits is different from the second pattern of slits.

28. The package of claim 24, wherein the steam-venting system includes a first row having a first pattern of slits and a second row having a second pattern of slits and the first pattern of slits is the same as the second pattern of slits.

29. The package of claim 24, wherein the top wall includes a first panel positioned to locate the seal-fin line between the first and second edges and a second panel positioned to lie between the seal-fin line and second edge, the first panel includes a u-shaped outer field extending between the first and second ends and the first edge and the seal-fin line and an inner field surrounded by the u-shaped outer field and the second panel, and the steam-venting system is formed in the inner field.

30. The package of claim 24, wherein the container further includes a first side wall arranged to interconnect the top wall and the bottom wall, the first side wall extending along the first edge of the container between the first and second ends of the container.

31. The package of claim 24, wherein the container further includes a first side wall arranged to interconnect the top and bottom walls and extend along the first edge of the container and a second side wall arranged to interconnect and extend along the second edge of the container and the first and second side walls are arranged to extend between the first and second ends of the container.

* * * * *